US008942587B2

(12) United States Patent
Takahashi et al.

(10) Patent No.: US 8,942,587 B2
(45) Date of Patent: Jan. 27, 2015

(54) ELECTROSTATIC IMAGE DEVELOPER AND IMAGE FORMING APPARATUS

(71) Applicant: Fuji Xerox Co., Ltd., Tokyo (JP)

(72) Inventors: Sakon Takahashi, Kanagawa (JP); Akihiro Iizuka, Kanagawa (JP); Motoko Sakai, Kanagawa (JP); Kunihiko Sato, Kanagawa (JP); Kazuhiko Arai, Kanagawa (JP); Nobumasa Furuya, Kanagawa (JP); Masaaki Takahashi, Kanagawa (JP); Daisuke Haruyama, Kanagawa (JP); Koji Nishimura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 42 days.

(21) Appl. No.: 13/912,656

(22) Filed: Jun. 7, 2013

(65) Prior Publication Data

US 2014/0178100 A1 Jun. 26, 2014

(30) Foreign Application Priority Data

Dec. 21, 2012 (JP) ..... 2012-279252

(51) Int. Cl.
*G03G 15/08* (2006.01)
*G03G 9/083* (2006.01)

(52) U.S. Cl.
CPC ..... *G03G 9/0833* (2013.01); *G03G 15/08* (2013.01); *G03G 15/0813* (2013.01); *G03G 2215/0838* (2013.01)
USPC ..... 399/53; 399/119; 399/142; 399/237

(58) Field of Classification Search
USPC ..... 399/252, 111, 159, 335, 286, 100, 110, 399/27, 285, 45, 53, 143
See application file for complete search history.

(56) References Cited

U.S. PATENT DOCUMENTS

2005/0214668 A1 * 9/2005 Miyakawa et al. ..... 430/108.7
2013/0244155 A1 * 9/2013 Satoh et al. ..... 430/105

FOREIGN PATENT DOCUMENTS

JP A-2005-099323 4/2005
JP A-2007-286246 11/2007

* cited by examiner

*Primary Examiner* — Walter L Lindsay, Jr.
*Assistant Examiner* — Roy Y Yi
(74) *Attorney, Agent, or Firm* — Oliff PLC

(57) ABSTRACT

An electrostatic image developer includes a toner containing an external additive having a volume-average particle size of about 80 to 400 nm and an average circularity of about 0.7 to 0.85. The developer is used in an image forming apparatus including an image-carrying member having a top surface layer containing fluorocarbon resin particles, and a developer-carrying member that faces the image-carrying member and carries an electrostatic image developer, in which a value obtained by dividing the amount of developer on the developer-carrying member [g/m$^2$] by a shortest distance between the image-carrying member and the developer-carrying member [μm] is about 0.8 to 1.8, and a peripheral velocity ratio of the developer-carrying member to the image-carrying member is about 1.5 to 5.0 or the developer-carrying member moves in a direction opposite to the image-carrying member in a facing portion.

6 Claims, 4 Drawing Sheets

| | DEVELOPMENT NIP CONDITIONS | | | DEVELOPMENT CONDITIONS | | | | EXTERNAL ADDITIVE | | PHOTO-RECEPTOR |
|---|---|---|---|---|---|---|---|---|---|---|
| | MOS g/m$^2$ | DRS μm | MOS/DRS | PHOTO-RECEPTOR SPEED | DEVELOPING ROLLER SPEED | PERIPHERAL VELOCITY RATIO | ROTATION DIRECTION | PARTICLE SIZE | AVERAGE CIRCULARITY | PTFE |
| EXAMPLE 1 | 300 | 300 | 1.0 | 300 | 500 | 1.7 | IDENTICAL | 118 nm | 0.78 | CONTAINED |
| EXAMPLE 2 | 250 | 300 | 0.83 | 300 | 500 | 1.7 | IDENTICAL | 118 nm | 0.78 | CONTAINED |
| EXAMPLE 3 | 350 | 300 | 1.17 | 300 | 500 | 1.7 | IDENTICAL | 118 nm | 0.78 | CONTAINED |
| EXAMPLE 4 | 420 | 250 | 1.68 | 300 | 500 | 1.7 | IDENTICAL | 118 nm | 0.78 | CONTAINED |
| EXAMPLE 5 | 300 | 300 | 1.0 | 300 | 700 | 2.3 | IDENTICAL | 118 nm | 0.78 | CONTAINED |
| EXAMPLE 6 | 300 | 300 | 1.0 | 300 | 360 | 1.2 | REVERSE | 118 nm | 0.78 | CONTAINED |
| EXAMPLE 7 | 300 | 300 | 1.0 | 300 | 500 | 1.7 | IDENTICAL | 86 nm | 0.75 | CONTAINED |
| EXAMPLE 8 | 300 | 300 | 1.0 | 300 | 500 | 1.7 | IDENTICAL | 122 nm | 0.83 | CONTAINED |
| COMPARATIVE EXAMPLE 1 | 300 | 300 | 1.0 | 300 | 500 | 1.7 | IDENTICAL | 118 nm | 0.78 | NOT CONTAINED |
| COMPARATIVE EXAMPLE 2 | 300 | 300 | 1.0 | 300 | 500 | 1.7 | IDENTICAL | 58 nm | 0.75 | CONTAINED |
| COMPARATIVE EXAMPLE 3 | 300 | 300 | 1.0 | 300 | 500 | 1.7 | IDENTICAL | 120 nm | 0.96 | CONTAINED |

FIG. 3

| | DEVELOPMENT NIP CONDITIONS | | | DEVELOPMENT CONDITIONS | | | | EXTERNAL ADDITIVE | | PHOTO-RECEPTOR |
|---|---|---|---|---|---|---|---|---|---|---|
| | MOS $g/m^2$ | DRS μm | MOS/DRS | PHOTO-RECEPTOR SPEED | DEVELOPING ROLLER SPEED | PERIPHERAL VELOCITY RATIO | ROTATION DIRECTION | PARTICLE SIZE | AVERAGE CIRCULARITY | PTFE |
| EXAMPLE 1 | 300 | 300 | 1.0 | 300 | 500 | 1.7 | IDENTICAL | 118 nm | 0.78 | CONTAINED |
| EXAMPLE 2 | 250 | 300 | 0.83 | 300 | 500 | 1.7 | IDENTICAL | 118 nm | 0.78 | CONTAINED |
| EXAMPLE 3 | 350 | 300 | 1.17 | 300 | 500 | 1.7 | IDENTICAL | 118 nm | 0.78 | CONTAINED |
| EXAMPLE 4 | 420 | 250 | 1.68 | 300 | 500 | 1.7 | IDENTICAL | 118 nm | 0.78 | CONTAINED |
| EXAMPLE 5 | 300 | 300 | 1.0 | 300 | 700 | 2.3 | IDENTICAL | 118 nm | 0.78 | CONTAINED |
| EXAMPLE 6 | 300 | 300 | 1.0 | 300 | 360 | 1.2 | REVERSE | 118 nm | 0.78 | CONTAINED |
| EXAMPLE 7 | 300 | 300 | 1.0 | 300 | 500 | 1.7 | IDENTICAL | 86 nm | 0.75 | CONTAINED |
| EXAMPLE 8 | 300 | 300 | 1.0 | 300 | 500 | 1.7 | IDENTICAL | 122 nm | 0.83 | CONTAINED |
| COMPARATIVE EXAMPLE 1 | 300 | 300 | 1.0 | 300 | 500 | 1.7 | IDENTICAL | 118 nm | 0.78 | NOT CONTAINED |
| COMPARATIVE EXAMPLE 2 | 300 | 300 | 1.0 | 300 | 500 | 1.7 | IDENTICAL | 58 nm | 0.75 | CONTAINED |
| COMPARATIVE EXAMPLE 3 | 300 | 300 | 1.0 | 300 | 500 | 1.7 | IDENTICAL | 120 nm | 0.96 | CONTAINED |

FIG. 4

| | DEVELOPABILITY | | TRANSFERABILITY | | CONTAMINATION OF PHOTORECEPTOR | | DEFECT | COMPREHENSIVE EVALUATION RESULT |
|---|---|---|---|---|---|---|---|---|
| EXAMPLE 1 | 4.1 | A | 97% | A | 8% | A | | A |
| EXAMPLE 2 | 3.8 | B | 97% | A | 17% | B | DEVELOPABILITY DECREASES CONTAMINATION OF PHOTORECEPTOR TENDS TO INCREASE | B |
| EXAMPLE 3 | 4.3 | A | 97% | A | 7% | A | | A |
| EXAMPLE 4 | 4.6 | A | 97% | A | 6% | A | TORQUE FOR DRIVING DEVELOPING ROLLER INCREASES | A |
| EXAMPLE 5 | 4.5 | A | 97% | A | 5% | A | | A |
| EXAMPLE 6 | 4.2 | A | 97% | A | 5% | A | | A |
| EXAMPLE 7 | 4.0 | A | 92% | B | 6% | A | TRANSFERABILITY DECREASES | A |
| EXAMPLE 8 | 4.0 | A | 98% | A | 16% | B | CONTAMINATION OF PHOTORECEPTOR TENDS TO INCREASE | A |
| COMPARATIVE EXAMPLE 1 | 4.1 | A | 92% | B | 32% | C | CONTAMINATION OF PHOTORECEPTOR IS OBSERVED | C |
| COMPARATIVE EXAMPLE 2 | 3.9 | B | 83% | C | 5% | A | TRANSFERABILITY IS NOT GOOD | C |
| COMPARATIVE EXAMPLE 3 | 4.2 | A | 96% | A | 28% | C | CONTAMINATION OF PHOTORECEPTOR IS NOT GOOD | C |

ELECTROSTATIC IMAGE DEVELOPER AND IMAGE FORMING APPARATUS

CROSS-REFERENCE TO RELATED APPLICATIONS

This application is based on and claims priority under 35 USC 119 from Japanese Patent Application No. 2012-279252 filed Dec. 21, 2012.

BACKGROUND

1. Technical Field

The present invention relates to an electrostatic image developer and an image forming apparatus.

2. Summary

According to an aspect of the invention, there is provided an electrostatic image developer including a toner that contains an external additive having a volume-average particle size of about 80 nm or more and about 400 nm or less and an average circularity of about 0.7 or more and about 0.85 or less. The electrostatic image developer is used in an image forming apparatus including an image-carrying member that has a top surface layer containing fluorocarbon resin particles dispersed therein and that carries an electrostatic latent image, and a developer-carrying member that is arranged so as to face the image-carrying member and that carries an electrostatic image developer, in which a value obtained by dividing the amount of developer per unit area carried on the developer-carrying member [g/m$^2$] by a shortest distance between the image-carrying member and the developer-carrying member [μm] is about 0.8 or more and about 1.8 or less, and a peripheral velocity ratio of a peripheral velocity of the developer-carrying member to a peripheral velocity of the image-carrying member is about 1.5 or more and about 5.0 or less or the developer-carrying member moves in a direction opposite to a moving direction of the image-carrying member in a portion where the developer-carrying member and the image-carrying member face each other.

BRIEF DESCRIPTION OF THE DRAWINGS

Exemplary embodiments of the present invention will be described in detail based on the following figures, wherein:

FIG. 3 is a table showing the conditions of Examples and Comparative Examples; and FIG. 4 is a table showing the results of Examples and Comparative Examples.

DETAILED DESCRIPTION

An electrostatic image developer and an image forming apparatus according to an exemplary embodiment of the present invention will now be described with reference to the drawings.

First Exemplary Embodiment

Figure 1:
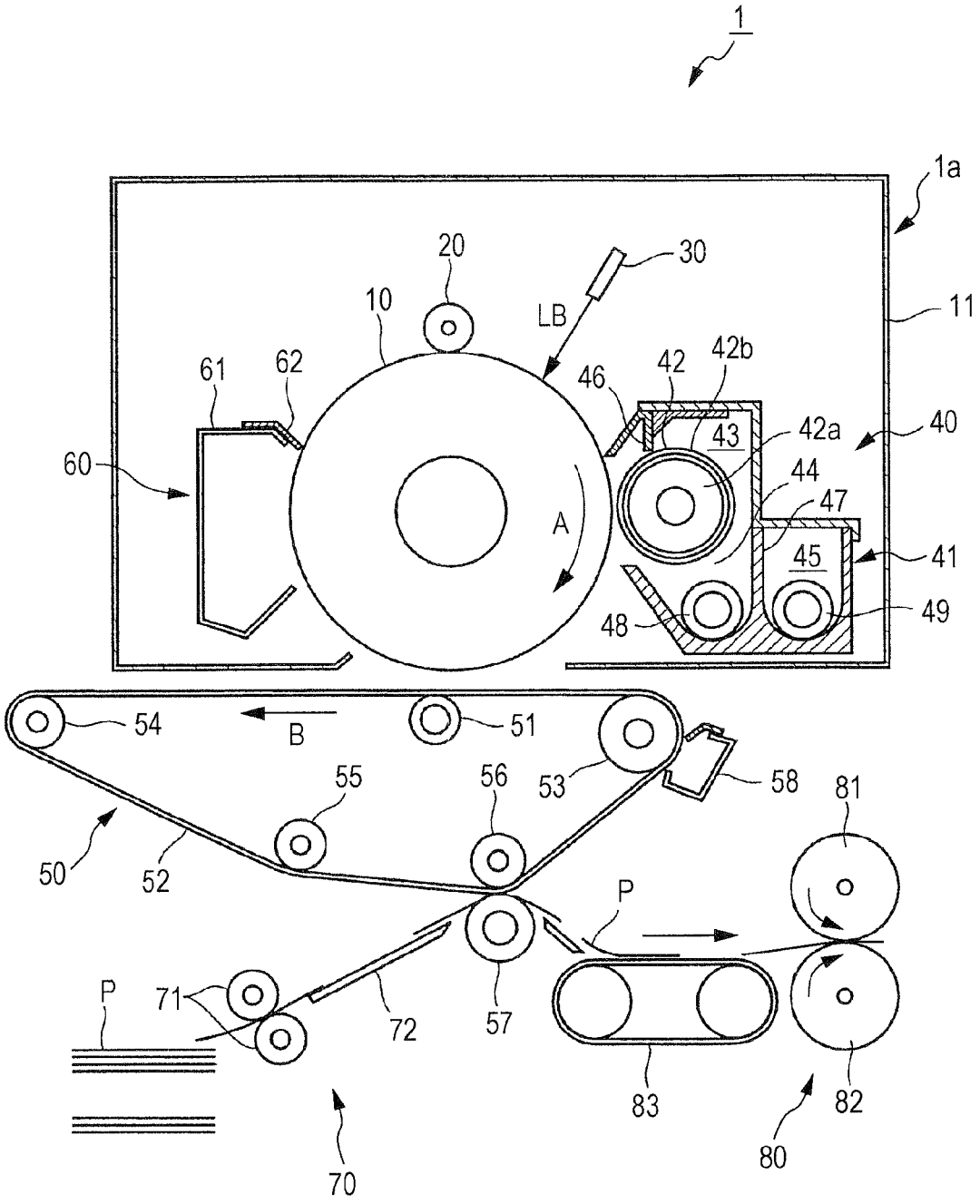
FIG. 1 is a structural view illustrating an image forming apparatus according to a first exemplary embodiment of the present invention.

As illustrated in FIG. 1, an image forming apparatus 1 according to a first exemplary embodiment includes a drum-shaped electrophotographic photoreceptor 10 which is an example of an image-carrying member that rotates in the clockwise direction as shown by arrow A. The following devices, namely, a charging device 20, an exposure device 30, a developing device 40, an intermediate transfer device 50, a drum-cleaning device 60, etc. are arranged around the electrophotographic photoreceptor 10. The charging device 20 is an example of a charging unit that charges a circumferential surface (image-carrying surface) of the electrophotographic photoreceptor 10, on which an image can be formed, to a predetermined potential. The exposure device 30 is an example of an electrostatic latent image-forming unit that radiates light based on information (signal) of an image onto the charged circumferential surface of the electrophotographic photoreceptor 10 to form an electrostatic latent image having a potential difference. The developing device 40 is an example of a developing unit that develops the electrostatic latent image with a toner of an electrostatic image developer to form a toner image. The intermediate transfer device 50 functions as a transfer unit that contacts the surface of the electrophotographic photoreceptor 10 and moves to transfer the toner image developed on the surface of the electrophotographic photoreceptor 10 to recoding paper P. The drum-cleaning device 60 is an example of a cleaning unit that removes adhering matter such as a toner remaining on the image-carrying surface of the electrophotographic photoreceptor 10 to clean the image-carrying surface.

The intermediate transfer device 50, a paper feeding device 70, and a fixing device 80 are arranged below the electrophotographic photoreceptor 10. The intermediate transfer device 50 includes an intermediate transfer belt 52, plural belt support rollers 53 to 56, a second transfer device 57, and a belt cleaning device 58. The intermediate transfer belt 52 functions as an intermediate transfer body that rotates in the direction shown by arrow B while passing through a first transfer position between the electrophotographic photoreceptor 10 and a first transfer device 51 (first transfer roller). The belt support rollers 53 to 56 rotatably support the intermediate transfer belt 52 while holding the intermediate transfer belt 52 from the inner surface thereof in a desired state. The second transfer device 57 is arranged on the outer peripheral surface (image-carrying surface) side of the intermediate transfer belt 52 that is supported by the belt support roller 56 and secondarily transfers a toner image on the intermediate transfer belt 52 to the recording paper P functioning as a recording medium. The belt cleaning device 58 removes adhering matter such as a toner and paper dust that remain on the outer peripheral surface of the intermediate transfer belt 52 after passing through the second transfer device 57 to clean the intermediate transfer belt 52.

The intermediate transfer belt 52 may be an endless belt composed of a material obtained by dispersing, for example, a resistance-adjusting agent such as carbon black in a synthetic resin such as a polyimide resin or a polyamide resin. The belt support roller 53 function as a driving roller. The belt support roller 54 functions as a tension-applying roller. The belt support roller 55 functions as a driven roller that holds, for example, the running position of the intermediate transfer belt 52. The belt support roller 56 functions as a back-up roller of a second transfer.

As illustrated in FIG. 1, the second transfer device 57 is constituted by a second transfer roller arranged so as to contact a second transfer position, which is an outer peripheral surface portion of the intermediate transfer belt 52, the portion being supported by the belt support roller 56 in the intermediate transfer device 50. A DC voltage having a polarity opposite to or the same as the charging polarity of the toner is supplied as a voltage for the second transfer to the second transfer roller serving as the second transfer device 57 or the belt support roller 56 of the intermediate transfer device 50.

The fixing device 80 includes, for example, a drum-shaped heating rotary member 81 and a drum-shaped pressure rotary member 82. The heating rotary member 81 rotates in the direction indicated by the arrow and is heated by a heater so that a surface temperature thereof is maintained at a predetermined temperature. The pressure rotary member 82 is driven and rotated while contacting the heating rotary member 81 at a predetermined pressure so that the axial direction of the pressure rotary member 82 is substantially parallel to the axial direction of the heating rotary member 81. In this fixing device 80, a contact portion in which the heating rotary member 81 contacts the pressure rotary member 82 functions as a fixing treatment portion where a predetermined fixing treatment (heating and pressing) is performed.

The paper feeding device 70 includes at least one paper container (not shown) and a sending device 71. The paper container contains a desired type of recording paper P having a desired size etc. in a stacked manner. The sending device 71 sends the recording paper P serving as a recording medium from the paper container one by one.

A paper feed transport path constituted by a transport guiding member 72 that transports the recording paper P sent from the paper feeding device 70 to the second transfer position and plural pairs of paper transport rollers (not shown) is arranged between the paper feeding device 70 and the second transfer device 57. A pair of paper transport rollers (not shown) arranged at a position just before the second transfer position in the paper feed transport path functions as, for example, rollers (resist rollers) that adjust the transport timing of the recording paper P. A paper transport device 83 having a belt shape or the like is provided between the second transfer device 57 and the fixing device 80. The paper transport device 83 transports the recording paper P after the second transfer, which is sent from the second transfer device 57, to the fixing device 80.

Components in the image forming apparatus 1 according to the present exemplary embodiment will now be described in detail.

Electrostatic Image Developer

An electrostatic image developer according to the present exemplary embodiment is a two-component developer containing a toner and a carrier. The toner includes toner particles containing, for example, a binder resin, a colorant, and, as required, other additives such as a release agent; and an external additive having a volume-average particle size of 80 nm or more and 400 nm or less or about 80 nm or more and about 400 nm or less and an average circularity of 0.7 or more and 0.85 or less or about 0.7 or more and about 0.85 or less.

First, the toner particles will be described.

Examples of the binder resin include, but are not particularly limited to, homopolymers and copolymers of styrenes (such as styrene and chlorostyrene), monoolefins (such as ethylene, propylene, and butylene), diolefines (such as isoprene), vinyl esters (such as vinyl acetate, vinyl propionate, vinyl benzoate, and vinyl butyrate), α-methylene aliphatic monocarboxylic acid esters (such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate), vinyl ethers (such as vinyl methyl ether, vinyl ethyl ether, and vinyl butyl ether), and vinyl ketones (such as vinyl methyl ketone, vinyl hexyl ketone, and vinyl isopropenyl ketone); and polyester resins obtained by polycondensation of a dicarboxylic acid and a diol.

Examples of the particularly typical binder resin include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene resins, polypropylene resins, and polyester resins.

Examples of the typical binder resin include polyurethanes, epoxy resins, silicone resins, polyamides, modified rosin, and paraffin wax.

Examples of the typical colorant include magnetic powders (such as a magnetite powder and a ferrite powder), carbon black, aniline blue, calco oil blue, chrome yellow, ultramarine blue, Du Pont Oil Red, quinoline yellow, methylene blue chloride, phthalocyanine blue, malachite green oxalate, lamp black, rose bengal, C. I. Pigment Red 48:1, C. I. Pigment Red 122, C. I. Pigment Red 57:1, C. I. Pigment Yellow 97, C. I. Pigment Yellow 17, C. I. Pigment Blue 15:1 and C. I. Pigment Blue 15:3.

Examples of the other additives include release agents, magnetic substances, charge control agents, and inorganic powders.

Examples of the release agents include, but are not limited to, hydrocarbon wax; natural wax such as carnauba wax, rice wax, and candelilla wax; synthetic or mineral/petroleum wax such as montan wax; ester wax such as fatty acid esters and montanic acid esters.

Characteristics of the toner particles will now be described.

The toner particles preferably have an average shape factor (a number average of a shape factor represented by Shape factor=$(ML^2/A)\times(\pi/4)\times100$ where ML denotes a maximum length of a particle and A denotes a projected area of the particle) of 100 or more and 150 or less, more preferably 105 or more and 145 or less, and still more preferably 110 or more and 140 or less.

The toner particles have a volume-average particle size $D50_v$ of 2.0 μm or more and 6.5 μm or less, and preferably 2.0 μm or more and 6.0 μm or less.

When the volume-average particle size $D50_v$ of the toner particles is within the above range, the generation of a streak-like fog is suppressed.

By reducing the particle size of the toner particles, granularity of an image (image quality) is improved. However, if the volume-average particle size of the toner particles is smaller than 2.0 μm, the amount of charge per toner particle is excessively small, which may cause fog and transfer defects.

Herein, the volume-average particle size $D50_v$ of toner particles is measured by the following method.

First, 0.5 mg or more and 50 mg or less of a measurement sample is added to 2 mL of a 5 mass % aqueous solution of a surfactant (preferably, sodium alkylbenzene sulfonate) functioning as a dispersant, and the resulting mixture is added to 100 mL or more and 150 mL or less of an electrolyte solution. A dispersion treatment of this electrolyte solution containing the measurement sample suspended therein is conducted for about one minute with an ultrasonic dispersion device. A particle size distribution of particles having a particle size of 2.0 μm or more and 60 μm or less is measured with a Coulter Multisizer II (manufactured by Beckman Coulter, Inc.) using an aperture having an aperture diameter of 100 μm. The number of particles measured is 50,000.

The obtained particle size distribution is expressed as a volume-based cumulative distribution in ascending order in terms of particle size for each of divided particle size ranges (channels). A particle size providing 50% accumulation is defined as the volume-average particle size $D50_v$.

Next, the external additive will now be described.

In order to improve transferability of a toner, it is effective to decrease the adhesive force between each toner particle and the electrophotographic photoreceptor 10. In the present exemplary embodiment, in order to decrease the adhesive force between each toner particle and the electrophotographic photoreceptor 10, an external additive having a large particle size is added to the toner particles.

The volume-average particle size of the external additive is preferably 80 nm to 400 nm or about 80 nm to about 400 nm. When the volume-average particle size of the external additive is less than 80 nm or less than about 80 nm, the external additive has high adhesiveness to the toner particles and is readily embedded in the toner particles, and thus it is difficult to decrease the adhesive force between the electrophotographic photoreceptor and the resulting toner particles. When the particle size of the external additive exceeds 400 nm or about 400 nm, the adhesiveness to the toner particles is excessively low and the external additive is readily detached from the toner particles, and thus it is difficult to maintain the effect of the external additive.

The amount of irregular-shaped external additive relative to the toner is preferably 1% by mass or more and 5% by mass or less, or about 1% by mass or more and about 5% by mass or less. When the amount of irregular-shaped external additive relative to the toner is less than 1% by mass or less than about 1% by mass, the coating ratio of the external additive on the toner surface decreases and the external additive is embedded in the toner by a stress with time. Consequently, the function of the external additive as a spacer decreases, thereby degrading transferability. When the amount of irregular-shaped external additive relative to the toner is exceeds 5% by mass or about 5% by mass, the amount of external additive separated from the toner increases, resulting in contamination of the surface of the photoreceptor, a decrease in fluidity, and degradation of charging characteristics.

In addition, when an external additive having a large particle size is detached from the toner and adheres to the surface of the electrophotographic photoreceptor 10, in consideration that frictional electrification between the external additive and the electrophotographic photoreceptor 10 is promoted to suppress the adhesion of the external additive as described below, the external additive preferably has an irregular shape rather than a spherical shape. When the external additive has a spherical shape, the external additive rolls on the surface of the electrophotographic photoreceptor 10, and thus frictional electrification between the external additive and the electrophotographic photoreceptor 10 becomes weak. Thus, it is difficult to cause sufficient frictional electrification.

Therefore, the external additive preferably has an average circularity of 0.7 or more and 0.85 or less, or about 0.7 or more and about 0.85 or less. The average circularity of the external additive is 0.7 or more or about 0.7 or more from the standpoint of production. The average circularity of the external additive is 0.85 or less or about 0.85 or less from the standpoint of causing frictional electrification while suppressing rolling of the external additive on the surface of the electrophotographic photoreceptor 10. The circularity of the external additive is determined by observing the shape of the external additive with a microscope, and represented by the following formula:

Circularity=(Perimeter of circle having the same projected area as that of particle)/(Perimeter of particle)

Examples of the external additives include inorganic particles. Examples of the inorganic particles include particles of $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$ $Al_2O_3.2SiO_2$, $CaCO_3$, $MgCO_3$, $BaSO_4$, and $MgSO_4$.

The surfaces of the external additives may be subjected to a hydrophobizing treatment in advance. The hydrophobizing treatment is conducted by, for example, immersing inorganic particles in a hydrophobizing agent. Examples of the hydrophobizing agent include, but are not particularly limited to, silane coupling agents, silicone oil, titanate coupling agents, and aluminum coupling agents. These hydrophobizing agents may be used alone or in combination of two or more compounds.

By using an external additive having an irregular shape, scraping through of the external additive during cleaning may be suppressed, and the external additive is easily charged by frictional electrification with the surface of an image-carrying member during rubbing with a magnetic brush of the developer. When the external additive substantially has a spherical shape and adheres to the surface of an image-carrying member, the number of contact points and the contact area of the external additive are small, and the external additive easily forms a close-packed structure and is not readily subjected to frictional electrification.

Examples of the method for producing an external additive having an irregular shape include a method for producing fumed silica, the method including gasifying a silicon chloride to synthesize silica fine particles by a gas-phase reaction in a hydrogen flame at a high temperature, and a sol-gel method including hydrolyzing an alkyl silicate in an aqueous solvent containing an alcohol in the presence of a catalyst that promotes the hydrolysis to generate silica fine particles.

A method for producing a toner will now be described.

The toner particles are not particularly limited by a production method thereof. Toner particles produced by any of the methods described below are used in the present exemplary embodiment. Examples of the method include a kneading/pulverizing method in which a binder resin, a colorant, a release agent, and if necessary, a charge control agent, and other components are kneaded, pulverized, and classified; a method in which the shape of particles obtained by the kneading/pulverizing method is changed by a mechanical impact or thermal energy; an emulsion polymerization/aggregation method in which a polymerizable monomer of a binder resin is subjected to emulsion polymerization, the resulting dispersion liquid and a dispersion liquid containing a colorant, a release agent, and if necessary, a charge control agent, and other components are mixed, and the mixture is aggregated and coalesced by heating to obtain toner particles; a suspension polymerization method in which a polymerizable monomer for obtaining a binder resin and a solution containing a colorant, a release agent, and if necessary, a charge control agent, and other components are suspended in an aqueous solvent, and the resulting suspension is polymerized; and a dissolution/suspension method in which a binder resin, and a solution containing a colorant, a release agent, and if necessary, a charge control agent, and other components are suspended in an aqueous solvent, and granulation is conducted.

Alternatively, other known production methods may be employed. For example, the toner particles obtained by any of the above methods may be used as a core, and aggregated particles may further be caused to adhere and coalesce by heating so that the resulting toner particles have a core-shell structure. From the standpoint of the shape control and the particle size distribution control, methods in which toner particles are produced in an aqueous solvent, such as the suspension polymerization method, the emulsion polymerization/aggregation method, and the dissolution/suspension method are preferable. The emulsion polymerization/aggregation method is particularly preferable.

The toner is produced by mixing the above toner particles and the above external additive with a Henschel mixer, a V-blender, or the like. When the toner particles are produced by a wet method, the external additive may be mixed by the wet method.

Next, the carrier will be described.

The volume-average particle size $D50_v$ of the carrier is, for example, preferably 15 μm or more and 35 μm or less, more preferably 18 μm or more and 32 μm or less, and still more preferably 20 μm or more and 30 μm or less.

In addition, in the volume-average particle size distribution index GSDv of the carrier, for example, the proportion of carrier particles having a particle size of 45 μm or more is preferably 10% or less (more preferably 8% or less, and still more preferably 5% or less) of all the carrier particles.

When the amount of coarse particles (carrier particles having a particle size of 45 μm or more) is excessively large, the brush roughness of the magnetic brush tends to increase, and streak-like fog is readily generated. Therefore, it is desirable that the volume-average particle size distribution index GSDv of the carrier satisfy the above relationship.

The volume-average particle size $D50_v$ and volume-average particle size distribution index GSDv of the carrier are measured by using a laser scattering particle size analyzer (MICROTRACK, manufactured by Nikkiso Co., Ltd.) with an aperture diameter of 100 μm. In this case, the measurement is conducted after a carrier is dispersed in an aqueous electrolyte solution (aqueous ISOTON solution) and then dispersed for 30 seconds or more with ultrasonic waves.

A volume-based cumulative distribution curve is drawn in ascending order in terms of particle size for each of particle size ranges (channels) divided on the basis of the particle size distribution of the carrier measured with the laser scattering particle size analyzer (MICROTRACK, manufactured by Nikkiso Co., Ltd.). A particle size providing 50% accumulation is defined as the volume-average particle size $D50_v$. In the volume-average particle size distribution index GSDv, the proportion of particles having a particle size of 45 μm or more is determined from the channels.

The true specific gravity of the carrier (core material in the case of a coated carrier) is, for example, preferably 2.5 g/cm$^3$ or more and 6.0 g/cm$^3$ or less, more preferably 2.8 g/cm$^3$ or more and 5.5 g/cm$^3$ or less, and still more preferably 3.0 g/cm$^3$ or more and 5.0 g/cm$^3$ or less.

The true specific gravity of the carrier is a value determined as follows.

For example, in the case of a coated carrier, the true specific gravity p of the carrier is adjusted by the type of magnetic powder used. In the case of a magnetic powder-dispersed carrier, the true specific gravity p of the carrier is adjusted by the type of magnetic powder used, the amount of magnetic powder dispersed etc.

The true specific gravity of the carrier is measured, for example, in accordance with a gas-phase substitution method using a high-precision and automatic volumeter (for example, VM-100 manufactured by ESTEC).

Specific examples of the carrier include coated carriers obtained by coating the surface of a core material formed of a magnetic powder with a coating resin, magnetic powder-dispersed carriers obtained by dispersing and blending a magnetic powder in a matrix resin, and resin-impregnated carriers obtained by impregnating a porous magnetic powder with a resin.

The magnetic powder-dispersed carriers may be carriers containing particles obtained by dispersing and blending a magnetic powder in a matrix resin, the particles functioning as a core material and being coated with a coating resin. Similarly, the resin-impregnated carriers may be carriers containing particles obtained by impregnating a porous magnetic powder with a resin, the particles functioning as a core material and being coated with a coating resin.

Examples of the magnetic powder include magnetic metals such as iron, nickel, and cobalt, and magnetic oxides such as ferrite and magnetite.

Examples of the coating resin that coats a core material and the matrix resin in which a magnetic powder is dispersed and blended include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylic acid copolymers, straight silicone resins having an organosiloxane bond and modified resins thereof, fluorocarbon resins, polyesters, polycarbonates, phenolic resins, and epoxy resins.

The coating resin that coats a core material and the matrix resin in which a magnetic powder is dispersed and blended may contain other additives such as an electrically conductive material.

In order to coat the surface of the core material of the carrier with a coating resin, for example, the core material may be coated with a solution for forming a coating layer, the solution being prepared by dissolving the coating resin and optional additives in an appropriate solvent. The solvent is not particularly limited, and may be selected in view of the coating resin used, coating suitability, etc.

Specific examples of the resin coating method include a dipping method including dipping a core material in a solution for forming a coating layer, a spray method including spraying a solution for forming a coating layer onto the surface of a core material, a fluidized bed method including spraying a solution for forming a coating layer while floating a core material with flowing air, and a kneader coater method including mixing a core material of the carrier with a solution for forming a coating layer in a kneader coater, and removing a solvent.

Herein, the amount of coating resin that coats the core material is, for example, preferably 0.5% by mass or more (more preferably 0.7% by mass or more and 6% by mass or less, and still more preferably 1.0% by mass or more and 5.0% by mass or less) of the total mass of the carrier.

If the core material is excessively exposed and the exposed core material contacts the photoreceptor (image-carrying member), leakage of charge may readily occur.

Therefore, the amount of coating resin that coats the core material is preferably in the above range.

This amount of coating is determined as follows.

In the case of a coating resin that is soluble in a solvent, a carrier that has been accurately weighed is dissolved in a soluble solvent (for example, toluene), the magnetic powder is held with a magnet, and the solution in which the coating resin is dissolved is drained away. By repeating this operation several times, the magnetic powder from which the coating resin has been removed remains. The magnetic powder is dried, and the mass of the magnetic powder is then measured. The amount of coating is calculated by dividing the difference by the mass of the carrier.

More specifically, 20.0 g of a carrier is weighed and put in a beaker, 100 g of toluene is then added thereto, and the resulting mixture is stirred with a blade for 10 minutes. A magnet is brought into contact with the bottom of the beaker, and the toluene is drained away in such a way that the core material (magnetic powder) does not flow out. This operation is repeated four times, and the beaker after the toluene is drained away is dried. After the drying, the amount of the magnetic powder is measured. The amount of coating is calculated by using a formula [(the amount of carrier−the amount of magnetic powder after washing)/the amount of carrier].

On the other hand, in the case of a coating resin that is insoluble in a solvent, a carrier is heated in a nitrogen atmosphere in the range of room temperature (25° C.) or higher and 1,000° C. or lower with a Thermo plus EVO II differential thermogravimetric analyzer TG 8120 manufactured by Rigaku Corporation. The amount of coating is calculated from the decrease in the mass of the carrier.

In the developer, the mixing ratio (mass ratio) of the toner and the carrier is, for example, approximately in the range of toner:carrier=1:100 to 30:100.

(Developing Device)

As illustrated in FIG. 1, the developing device 40 is arranged so as to face the electrophotographic photoreceptor 10 in a developing region. The developing device 40 includes a developing device body 41 that contains a developer (two-component developer) containing a toner and a carrier therein.

The developing device body 41 has, inside thereof, a developing roller chamber 43 for installing a developing roller 42 serving as a developer-carrying member. Furthermore, the developing device body 41 has a first stirring chamber 44 and a second stirring chamber 45 adjacent to the first stirring chamber 44, the first and second stirring chambers 44 and 45 being adjacent to a lower portion of the developing roller chamber 43. A layer-thickness control member 46 that controls a layer thickness of the developer on the surface of the developing roller 42 is provided in the developing roller chamber 43. The first stirring chamber 44 and the second stirring chamber 45 are separated by a partition wall 47. The first stirring chamber 44 and the second stirring chamber 45 communicate with each other through openings provided at both ends in the longitudinal direction of the partition wall 47 so that the developer circulates between the first stirring chamber 44 and the second stirring chamber 45.

In the developing roller chamber 43, the developing roller 42 is arranged so as to face the electrophotographic photoreceptor 10. The developing roller 42 includes a magnetic roller 42*a* in which plural magnetic poles are arranged at predetermined positions in the circumferential direction and a developing sleeve 42*b* arranged on the outer circumference of the magnetic roller 42*a*. The magnetic roller 42*a* is installed so as to be fixed to the developing device body 41, and the developing sleeve 42*b* is installed in the developing device body 41 so as to rotate in the counterclockwise direction. The developing roller 42 faces the surface of the electrophotographic photoreceptor 10 at a closest position with a predetermined gap (shortest distance) therebetween. The developer in the first stirring chamber 44 is adsorbed on the surface of the developing sleeve 42*b* by the magnetic force of the magnetic roller 42*a*, and is transported to the developing region as a magnetic brush of the developer with the rotation of the developing sleeve 42*b* while the layer thickness of the developer is controlled by the layer-thickness control member 46. The magnetic brush of the developer carried on the surface of the developing sleeve 42*b* contacts the surface of the electrophotographic photoreceptor 10, thereby developing an electrostatic latent image formed on the surface of the electrophotographic photoreceptor 10 to form a toner image. The amount of developer per unit area, the developer being carried on the surface of the developing sleeve 42*b* and transported to the developing region, is determined by the gap between the layer-thickness control member 46 and the developing sleeve 42*b* and the magnetic force of the magnetic roller 42*a*.

The developing sleeve 42*b* of the developing roller 42 is driven by a driving unit (not shown) so as to rotate, for example, in a direction opposite to the rotation direction of the electrophotographic photoreceptor 10 (clockwise direction). The developer adsorbed on the surface of the developing sleeve 42*b* is transported to the developing region in a direction the same as the moving direction of the electrophotographic photoreceptor 10 (for the sake of convenience, this direction is referred to as "identical" direction) at a predetermined peripheral velocity ratio (ratio of a moving velocity of the surface of the developing roller 42 to a moving velocity of the surface of the electrophotographic photoreceptor 10) in a portion where the electrophotographic photoreceptor 10 and the developing roller 42 face each other (hereinafter also referred to as "facing portion").

Alternatively, the developing sleeve 42*b* of the developing roller 42 may be driven so as to rotate in the same direction as the rotation direction of the electrophotographic photoreceptor 10. The developer adsorbed on the surface of the developing sleeve 42*b* may be transported to the developing region in a direction opposite to the moving direction of the electrophotographic photoreceptor 10 (for the sake of convenience, this direction is referred to as "reverse" direction) at a predetermined peripheral velocity ratio in the facing portion.

A bias power supply (not shown) is connected to the developing sleeve 42*b* of the developing roller 42. In this exemplary embodiment, a developing bias is applied in which an alternating-current component (AC) is superimposed on a direct-current component (DC) having a negative polarity that is the same as the charging polarity of the toner.

In the first stirring chamber 44 and the second stirring chamber 45, a first stirring member 48 and a second stirring member 49 each of which functions as a stirring/transport member that transports the developer while stirring the developer are respectively arranged. The first stirring member 48 includes a first rotation shaft extending in the axial direction of the developing roller 42, and a stirring transport blade (projecting portion) which is fixed to an outer circumference of the rotation shaft in a spiral manner. Similarly, the second stirring member 49 also includes a second rotation shaft and a stirring transport blade (projecting portion). Each of the stirring members 48 and 49 is rotatably supported by the developing device body 41. The first stirring member 48 and the second stirring member 49 are arranged so that the developer in the first stirring chamber 44 and the developer in the second stirring chamber 45 are transported in opposite directions by their rotation. The first stirring member 48 supplies the developer to the developing roller 42 while stirring and transporting the developer.

One end in a longitudinal direction of the second stirring chamber 45 is connected to an end of a supplemental developer transporting path (not shown) for supplying a supplemental developer containing a supplemental toner and a supplemental carrier to the second stirring chamber 45. A supplemental developer container (not shown) containing the supplemental developer therein is connected to another end of the supplemental developer transporting path.

In this manner, in the developing device 40, the supplemental developer is supplied from the supplemental developer container (toner cartridge (not shown)) to the developing device 40 (second stirring chamber 45) through the supplemental developer transporting path.

The image forming apparatus according to the present exemplary embodiment is configured so that the developability of the developing device 40 is improved in order to realize high image quality and high productivity. Development parameters relating to the developability of the developing device 40 include an electrostatic latent image potential of the electrophotographic photoreceptor 10, a developing potential which is a developing bias potential applied to the developing roller 42, a parameter that specifies a developer contact region where the surface of the electrophotographic photoreceptor 10 contacts a magnetic brush of the developer carried on the developing roller 42, and a peripheral velocity ratio of a peripheral velocity of the developing roller 42 to a peripheral velocity of the electrophotographic photoreceptor 10. In the present exemplary embodiment, the parameter that specifies a developer contact region is controlled in order to improve the developability of the developing device 40. Here, parameters representing the contact state of the developer in the developing region include a shortest distance between the electrophotographic photoreceptor 10 and the developing roller 42 and the amount of developer per unit area carried on the developing roller 42 in the developing region.

By setting the shortest distance which is a gap between the electrophotographic photoreceptor 10 and the developing roller 42 to a small value, an effective developing electric field that acts on the developer present in the developing region becomes strong to improve the developability. By increasing the amount of developer per unit area carried on the developing roller 42, the amount of contact between the developer and the electrophotographic photoreceptor 10 increases and the contact area also increases, and the developability may be improved.

Accordingly, the larger the value of MOS/DRS, which is a ratio of the amount ($g/m^2$) of developer per unit area carried on the developing roller 42 (hereinafter also referred to as "mass on sleeve (MOS)") to the shortest distance (μm) between the electrophotographic photoreceptor 10 and the developing roller 42 (hereinafter also referred to as "drum to roll space (DRS)") (the value obtained by dividing the amount of developer per unit area carried on the developing roller 42 by the shortest distance between the electrophotographic photoreceptor 10 and the developing roller 42), the higher the developability.

According to the results of various studies and examinations conducted by the inventors of the present invention, the value of MOS/DRS is preferably in the range of 0.8 or more and 1.8 or less or about 0.8 or more and about 1.8 or less, and more preferably in the range of 0.95 or more and 1.5 or less. When the value of MOS/DRS is less than 0.8 or less than about 0.8, the amount of developer developed on the surface of the electrophotographic photoreceptor 10 decreases. When the value of MOS/DRS is more than 1.8 or more than about 1.8, the developer tends to be excessively clogged in the developer contact region.

The peripheral velocity ratio of the peripheral velocity of the developing roller 42 to the peripheral velocity of the electrophotographic photoreceptor 10 is preferably set to 1.5 or more and 5.0 or less or about 1.5 or more and about 5.0 or less in the case where the developing roller 42 and the electrophotographic photoreceptor 10 move in the same direction in the facing portion. More preferably, the developing roller 42 and the electrophotographic photoreceptor 10 move in directions opposite to each other in the facing portion.

The peripheral velocity ratio of the peripheral velocity of the developing roller 42 to the peripheral velocity of the electrophotographic photoreceptor 10 is set to 1.5 or more or about 1.5 or more from the standpoint of frictional electrification of an external additive adhering to the surface of the electrophotographic photoreceptor 10. The peripheral velocity ratio is set to 5.0 or less or about 5.0 or less from the standpoint of suppressing the adhesion of an external additive to the surface of the electrophotographic photoreceptor 10.

(Electrophotographic Photoreceptor)

In the present exemplary embodiment, as described above, an external additive having a large particle size is caused to adhere to toner particles in the developer in order to improve the transferability of the toner. In the case where an external additive having a large particle size is caused to adhere to toner particles, the contact area with toner particles relative to the volume of the external additive decreases, and thus the external additive is easily separated from the toner particles. In addition, the value of MOS/DRS in the developing device 40 is set to a relatively large value in order to improve the developability, and thus the external additive tends to be easily separated from the toner particles. When an external additive charged to have a negative polarity is separated from toner particles, the external additive strongly adheres to the surface of the electrophotographic photoreceptor 10, and it is difficult to remove the external additive with the drum-cleaning device 60. Consequently, when the surface of the electrophotographic photoreceptor 10 is charged by the charging device 20, not only the surface of the electrophotographic photoreceptor 10 but also the external additive present on the surface of the electrophotographic photoreceptor 10 is charged. When an electrostatic latent image on the surface of the electrophotographic photoreceptor 10 is then developed with the developing device 40, the external additive adhering to the surface of the electrophotographic photoreceptor 10 is scraped by a magnetic brush of the developer. Consequently, the charge potential of a region where the external additive has adhered becomes lower than that of a region where the external additive does not adhere, thereby generating a potential difference between the two regions. Thus, a positive ghost image is readily induced on the resulting developed image.

In the present exemplary embodiment, in order to suppress the adhesion of an external additive, which is composed of inorganic particles that tend to be charged to have a negative polarity, to the surface of the electrophotographic photoreceptor 10, fluorocarbon resin particles, which are composed of a material that is charged to have a negative polarity in the frictional electrification series more easily than an external additive composed of inorganic particles, are dispersed in a top surface layer of the electrophotographic photoreceptor 10. In this case, the fluorocarbon resin particles have an average primary particle size of 0.05 μm or more and 1 μm or less or about 0.05 μm or more and about 1 μm or less, and the amount of fluorocarbon resin particles added is 1% by mass or more and 30% by mass or less or about 1% by mass or more and about 30% by mass or less.

Examples of the electrophotographic photoreceptor 10 include (1) a photoreceptor including a conductive base, an undercoat layer formed on the conductive base, and a charge generation layer, a charge transport layer, and a protective layer that are sequentially formed on the undercoat layer in that order, (2) a photoreceptor including a conductive base, an undercoat layer formed on the conductive base, and a charge transport layer, a charge generation layer, and a protective layer that are sequentially formed on the undercoat layer in that order, and (3) a photoreceptor including a conductive base, an undercoat layer formed on the conductive base, and a single-layer photosensitive layer and a protective layer that are sequentially formed on the undercoat layer in that order.

The charge generation layer and the charge transport layer are function-separated photosensitive layers. The electrophotographic photoreceptor 10 may include the undercoat layer or may not include the undercoat layer.

For example, a protective layer constituted by a cured film containing fluorocarbon resin particles is used as the protective layer constituting the top surface layer of the electrophotographic photoreceptor 10.

Each of the above layers will be described in detail below.

First, the conductive base will be described.

Any conductive base that has been commonly used may be used as the conductive base. Examples of the conductive base include metals such as aluminum, nickel, chromium, and stainless steel; plastic films or the like having a thin film (such as a thin film made of aluminum, titanium, nickel, chromium, stainless steel, gold, vanadium, tin oxide, indium oxide, or indium tin oxide (ITO)) thereon; paper onto which a conductivity-imparting agent is applied or which is impregnated with a conductivity-imparting agent; and plastic films onto which a conductivity-imparting agent is applied or which is impregnated with a conductivity-imparting agent. The shape of the base is not limited to a cylindrical shape, and may be a sheet-like shape or a plate-like shape.

Conductive base particles having a conductivity of, for example, less than $10^7$ Ω·cm in terms of volume resistivity may be used.

When a metal pipe is used as the conductive base, the surface of the metal pipe may be that of the original pipe. Alternatively, a treatment such as mirror surface cutting, etching, anodic oxidation, rough cutting, centerless grinding, sandblasting, or wet honing may be conducted on the surface in advance.

Next, the undercoat layer will be described.

The undercoat layer is provided as required in order to prevent light reflection on the surface of the conductive base and to prevent an unnecessary carrier from flowing from the conductive base to a photosensitive layer.

The undercoat layer contains a binder resin and optional other additives.

Examples of the binder resin contained in the undercoat layer include known polymer compounds such as acetal resins e.g., polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolic resins, phenol-formaldehyde resins, melamine resins, and urethane resins; charge transporting resins having a charge transporting group; and conductive resins such as polyaniline. Among these resins, resins that are insoluble in a solvent of a composition used for forming an upper layer are preferably used. For example, phenolic resins, phenol-formaldehyde resins, melamine resins, urethane resins, and epoxy resins are particularly preferably used.

The undercoat layer may contain a metallic compound such as a silicon compound, an organozirconium compound, an organotitanium compound, or an organoaluminum compound.

The ratio of the metallic compound to the binder resin is not particularly limited, and is determined within a range in which desired electrophotographic photoreceptor characteristics are achieved.

Resin particles may be added to the undercoat layer for the purpose of adjusting the surface roughness. Examples of the resin particles include silicone resin particles and cross-linked polymethyl methacrylate (PMMA) resin particles. In order to adjust the surface roughness, after the formation of the undercoat layer, the surface of the undercoat layer may be polished. Examples of the polishing method include buffing, sandblasting, wet honing, and grinding.

The undercoat layer contains at least a binder resin and conductive particles, for example. The conductive particles preferably have a conductivity of, for example, less than $10^7$ Ω·cm in terms of volume resistivity.

Examples of the conductive particles include metal particles (particles made of aluminum, copper, nickel, silver, or the like), conductive metal oxide particles (particles made of antimony oxide, indium oxide, tin oxide, zinc oxide, or the like), conductive substance particles (particles of carbon fibers, carbon black, and graphite powder). Among these conductive particles, conductive metal oxide particles are preferable. These conductive particles may be used in combination of two or more types of particles.

The conductive particles may be subjected to a surface treatment with a hydrophobizing agent (for example, a coupling agent) or the like so as to adjust the resistance.

The content of the conductive particles is, for example, preferably 10% by mass or more and 80% by mass or less, and more preferably 40% by mass or more and 80% by mass or less relative to the binder resin.

In forming the undercoat layer, a coating liquid for forming an undercoat layer is prepared by adding the above components to a solvent and used.

In a method for dispersing particles in the coating liquid for forming an undercoat layer, a media dispersion device such as a ball mill, a vibration ball mill, an attritor, a sand mill, or a horizontal-type sand mill, or a medialess dispersion device such as a stirrer, an ultrasonic dispersion device, a roll mill, or a high-pressure homogenizer may be used. Examples of the high-pressure homogenizer include a homogenizer that uses a collision method in which dispersion is performed by subjecting a dispersion liquid to liquid-liquid collision or liquid-wall collision in a high-pressure state, and a homogenizer that uses a flow-through method in which dispersion is performed by causing a dispersion liquid to pass through a fine flow path in a high-pressure state.

Examples of a method for applying the coating liquid for forming an undercoat layer onto the conductive base include dip coating, ring dip coating, wire-bar coating, spray coating, blade coating, knife coating, and curtain coating.

The thickness of the undercoat layer is preferably 15 μm or more, and more preferably 20 μm or more and 50 μm or less.

Although not illustrated in the figure, an intermediate layer may be further provided between the undercoat layer and the photosensitive layer. Examples of a binder resin used in the intermediate layer include polymer compounds such as acetal resins e.g., polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins; and organometallic compounds containing, for example, an atom of zirconium, titanium, aluminum, manganese, or silicon. These compounds may be used alone or as a mixture or polycondensate of two or more compounds. In particular, organometallic compounds containing zirconium or silicon are preferable from the standpoint that, for example, the residual potential is low, a change in the potential due to the environment is small, and a change in the potential caused by repeated use is small.

In forming the intermediate layer, a coating liquid for forming an intermediate layer is prepared by adding the above component to a solvent and used.

Examples of a coating method for forming the intermediate layer include common methods such as dip coating, ring dip coating, wire-bar coating, spray coating, blade coating, knife coating, and curtain coating.

The intermediate layer has a function of improving coatability of the upper layer, and also functions as an electrically blocking layer. However, if the thickness of the intermediate layer is excessively large, the electric barrier becomes excessively strong, which may cause desensitization and an increase in the potential due to repetition. Accordingly, in the case where the intermediate layer is formed, the thickness of the intermediate layer is preferably in the range of 0.1 μm or more and 3 μm or less. The intermediate layer in this case may also be used as an undercoat layer.

Next, the charge generation layer will be described.

The charge generation layer contains a charge-generating material and a binder resin. Examples of the charge-generating material include phthalocyanine pigments such as metal-free phthalocyanine, chlorogallium phthalocyanine, hydroxygallium phthalocyanine, dichlorotin phthalocyanine, and titanyl phthalocyanine. In particular, examples thereof include a chlorogallium phthalocyanine crystal having strong diffraction peaks at Bragg angles (2θ±0.2° of at least 7.4°, 16.6°, 25.5°, and 28.3° in an X-ray diffraction spectrum obtained by using CuKα characteristic X-rays; a metal-free phthalocyanine crystal having strong diffraction peaks at Bragg angles (2θ±0.2° of at least 7.7°, 9.3°, 16.9°, 17.5°, 22.4°, and 28.8° in an X-ray diffraction spectrum obtained by using CuKα characteristic X-rays; a hydroxygallium phthalocyanine crystal having strong diffraction peaks at Bragg angles (2θ±0.2° of at least 7.5°, 9.9°, 12.5°, 16.3°, 18.6°, 25.1°, and 28.3° in an X-ray diffraction spectrum obtained by using CuKα characteristic X-rays; and a titanyl phthalocyanine crystal having strong diffraction peaks at Bragg angles (2θ±0.2° of at least 9.6°, 24.1°, and 27.2° in an X-ray diffraction spectrum obtained by using CuKα characteristic X-rays. Examples of the charge-generating material further include quinone pigments, perylene pigments, indigo pigments, bisbenzimidazole pigments, anthrone pigments, and quinacridone pigments. These charge-generating materials may be used alone or in combination of two or more materials.

Examples of the binder resin contained in the charge generating layer include polycarbonate resins such as bisphenol A polycarbonate resins and bisphenol Z polycarbonate resins, acrylic resins, methacrylic resins, polyarylate resins, polyester resins, polyvinyl chloride resins, polystyrene resins, acrylonitrile-styrene copolymers, acrylonitrile-butadiene copolymers, polyvinyl acetate resins, polyvinyl formal resins, polysulfone resins, styrene-butadiene copolymers, vinylidene chloride-acrylonitrile copolymers, vinyl chloride-vinyl acetate-maleic anhydride resins, silicone resins, phenol-formaldehyde resins, polyacrylamide resins, polyamide resins, and poly-N-vinylcarbazole resins. These binder resins may be used alone or in combination of two or more resins.

The mixing ratio of the charge-generating material to the binder resin is preferably in the range of, for example, 10:1 to 1:10.

In forming the charge generation layer, a coating liquid for forming a charge generation layer is prepared by adding the above components to a solvent and used.

In a method for dispersing particles (e.g., charge-generating material) in the coating liquid for forming a charge generation layer, a media dispersion device such as a ball mill, a vibration ball mill, an attritor, a sand mill, or a horizontal-type sand mill, or a medialess dispersion device such as a stirrer, an ultrasonic dispersion device, a roll mill, or a high-pressure homogenizer may be used. Examples of the high-pressure homogenizer include a homogenizer that uses a collision method in which dispersion is performed by subjecting a dispersion liquid to liquid-liquid collision or liquid-wall collision in a high-pressure state and a homogenizer that uses a flow-through method in which dispersion is performed by causing a dispersion liquid to pass through a fine flow path in a high-pressure state.

Examples of a method for applying the coating liquid for forming a charge generation layer onto the undercoat layer include dip coating, ring dip coating, wire-bar coating, spray coating, blade coating, knife coating, and curtain coating.

The thickness of the charge generation layer is preferably 0.01 μm or more and 5 μm or less, and more preferably 0.05 μm or more and 2.0 μm or less.

Next, the charge transport layer will be described.

The charge transport layer contains a charge-transporting material and, as required, a binder resin. When the charge transport layer corresponds to the top surface layer, the charge transport layer contains fluorocarbon resin particles.

Examples of the charge-transporting material include hole-transporting substances such as oxadiazole derivatives, e.g., 2,5-bis(p-diethylaminophenyl)-1,3,4-oxadiazole, pyrazoline derivatives, e.g., 1,3,5-triphenyl-pyrazoline and 1-[pyridyl-(2)]-3-(p-diethylaminostyryl)-5-(p-diethylaminostyryl) pyrazoline, aromatic tertiary amino compounds, e.g., triphenylamine, N,N'-bis(3,4-dimethylphenyl)biphenyl-4-amine, tri(p-methylphenyl)aminyl-4-amine, and dibenzylaniline, aromatic tertiary diamino compounds, e.g., N,N'-bis(3-methylphenyl)-N,N'-diphenylbenzidine, 1,2,4-triazine derivatives, e.g., 3-(4'-dimethylaminophenyl)-5,6-di-(4'-methoxyphenyl)-1,2,4-triazine, hydrazone derivatives, e.g., 4-diethylaminobenzaldehyde-1,1-diphenylhydrazone, quinazoline derivatives, e.g., 2-phenyl-4-styryl-quinazoline, benzofuran derivatives, e.g., 6-hydroxy-2,3-di(p-methoxyphenyl)benzofuran, α-stilbene derivatives, e.g., p-(2,2-diphenylvinyl)-N,N'-diphenylaniline, enamine derivatives, carbazole derivatives, e.g., N-ethylcarbazole, and poly-N-vinylcarbazole and derivatives thereof; electron-transporting substances such as quinone compounds, e.g., chloranil and bromoanthraquinone, tetracyanoquinodimethane compounds, fluorenone compounds, e.g., 2,4,7-trinitrofluorenone and 2,4,5,7-tetranitro-9-fluorenone, xanthone compounds, and thiophene compounds. Examples of the charge-transporting material further include polymers having a group containing any of the above compounds in the main chain or a side chain thereof. These charge-transporting materials may be used alone or in combination of two or more materials.

Examples of the binder resin contained in the charge transport layer include insulating resins such as polycarbonate resins, e.g., bisphenol A polycarbonate resins and bisphenol Z polycarbonate resins, acrylic resins, methacrylic resins, polyarylate resins, polyester resins, polyvinyl chloride resins, polystyrene resins, acrylonitrile-styrene copolymers, acrylonitrile-butadiene copolymers, polyvinyl acetate resins, polyvinyl formal resins, polysulfone resins, styrene-butadiene copolymers, vinylidene chloride-acrylonitrile copolymers, vinyl chloride-vinyl acetate-maleic anhydride resins, silicone resins, phenol-formaldehyde resins, polyacrylamide resins, polyamide resins, and chlorine rubber; and organic photoconductive polymers such as polyvinyl carbazole, polyvinyl anthracene, and polyvinyl pyrene. These binder resins may be used alone or in combination of two or more resins.

The mixing ratio of the charge-transporting material to the binder resin is preferably in the range of, for example, 10:1 to 1:5.

The charge transport layer is formed using a coating liquid for forming a charge transport layer, the coating liquid being prepared by adding the above components to a solvent.

In a method for dispersing particles (e.g., fluorocarbon resin particles) in the coating liquid for forming a charge transport layer, a media dispersion device such as a ball mill, a vibration ball mill, an attritor, a sand mill, or a horizontal-type sand mill, or a medialess dispersion device such as a stirrer, an ultrasonic dispersion device, a roll mill, or a high-pressure homogenizer may be used. Examples of the high-pressure homogenizer include a homogenizer that uses a collision method in which dispersion is performed by subjecting a dispersion liquid to liquid-liquid collision or liquid-wall collision in a high-pressure state and a homogenizer that uses a flow-through method in which dispersion is performed by causing a dispersion liquid to pass through a fine flow path in a high-pressure state.

Examples of a method for applying the coating liquid for forming a charge transport layer onto the charge generation layer include common methods such as dip coating, ring dip coating, wire-bar coating, spray coating, blade coating, knife coating, and curtain coating.

The thickness of the charge transport layer is preferably in the range of 5 μm or more and 50 μm or less, and more preferably 10 μm or more and 40 μm or less.

Next, the single-layer photosensitive layer will be described.

In the single-layer photosensitive layer (charge generation/charge transport layer), for example, the content of the charge-generating material is preferably 10% by mass or more and 85% by mass or less (more preferably 20% by mass or more and 50% by mass or less), and the content of the charge-transporting material is preferably 5% by mass or more and 50% by mass or less.

The method for forming the single-layer photosensitive layer (charge generation/charge transport layer) is the same as the method for forming the charge generation layer or the charge transport layer.

The thickness of the single-layer photosensitive layer (charge generation/charge transport layer) is, for example, preferably about 5 μm or more and about 50 μm or less, and more preferably 10 μm or more and 40 μm or less.

Next, the protective layer will be described.

The protective layer is constituted by a cured film containing fluorocarbon resin particles.

Specifically, for example, the protective layer may be constituted by a cured film of a curable resin composition containing fluorocarbon resin particles, a curable resin, and a charge-transporting material.

Curable resins are crosslinkable resins that are polymerized by heating, light irradiation, or the like to form a polymer network structure, and thus that are cured and do not return to the original state. In particular, thermosetting resins are preferably used as the curable resins.

Examples of the thermosetting resins include, but are not limited to, melamine resins, phenolic resins, urea resins, benzoguanamine resins, epoxy resins, unsaturated polyester resins, alkyd resins, polyurethanes, polyimide resins, and curable acrylic resins. These thermosetting resins may be used alone or in combination of two or more resins.

The charge-transporting material is not particularly limited. However, the charge-transporting material is preferably a compound that is compatible with the curable resin, and more preferably a compound that forms a chemical bond with the curable resin used. Examples of the charge transporting organic compound having a reactive functional group that forms a chemical bond with the curable resin include compounds having at least one substituent selected from —OH, —$OCH_3$, —$NH_2$, —SH, and —COOH.

The protective layer may be constituted by a cured film of a curable composition containing fluorocarbon resin particles, at least one compound selected from guanamine compounds and melamine compounds, and a charge-transporting material having at least one substituent selected from —OH, —$OCH_3$, —$NH_2$, —SH, and —COOH (hereinafter simply referred to as "specific charge-transporting material").

As the curable resin, in addition to at least one compound selected from guanamine compounds and melamine compounds, for example, other curable resins (such as phenolic resins, melamine resins, urea resins, alkyd resins, and benzoguanamine resins) and spiroacetal guanamine resins (such as CTU-GUANAMINE manufactured by Ajinomoto Fine-Techno Co., Inc.) may be used in combination.

In the curable composition for forming a cured film functioning as the protective layer, the total content of the guanamine compounds and the melamine compounds relative to the total solid content except for the fluorocarbon resin particles (including a fluorinated alkyl group-containing copolymer that functions as a dispersant of the fluorocarbon resin particles) is preferably 0.1% by mass or more and 20% by mass or less, and the content of the specific charge-transporting material relative to the total solid content except for the fluorocarbon resin particles (including a fluorinated alkyl group-containing copolymer that functions as a dispersant of the fluorocarbon resin particles) is preferably 80% by mass or more and 99.9% by mass or less.

The guanamine compounds will be described.

The guanamine compounds are compounds having a guanamine skeleton (structure), and may be monomers or multimers. Herein, the term "multimer" refers to an oligomer obtained by polymerizing a monomer as a structural unit and the degree of polymerization of the multimer is, for example, 2 or more and 200 or less (and preferably 2 or more and 100 or less).

Examples of the guanamine compounds include acetoguanamine, benzoguanamine, formoguanamine, steroguanamine, spiroguanamine, and cyclohexylguanamine.

Examples of commercially available guanamine compounds include SUPER BECKAMINE (R) L-148-55, SUPER BECKAMINE (R) 13-535, SUPER BECKAMINE (R) L-145-60, and SUPER BECKAMINE (R) TD-126, all of which are manufactured by DIC Corporation; and NIKALAC BL-60 and NIKALAC BX-4000, which are manufactured by Nippon Carbide Industries Co., Inc.

After the synthesis of the guanamine compounds (including multimers) or after the purchase of the commercially available guanamine compounds (including multimers), the guanamine compounds (including multimers) may be dissolved in an appropriate solvent such as toluene, xylene, or ethyl acetate, and may be washed with distilled water, ion-exchange water, or the like in order to eliminate the effect of a residual catalyst. Alternatively, the guanamine compounds (including multimers) may be treated with an ion-exchange resin to remove the residual catalyst.

The guanamine compounds may be used alone or in combination of two or more compounds.

The melamine compounds will be described.

The melamine compounds are compounds having a melamine skeleton (structure), and may be monomers or multimers. Herein, the term "multimer" refers to an oligomer obtained by polymerizing a monomer as a structural unit and the degree of polymerization of the multimer is, for example, 2 or more and 200 or less (and preferably 2 or more and 100 or less).

Examples of commercially available melamine compounds include SUPER MELAMI No. 90 manufactured by NOF Corporation, SUPER BECKAMINE (R) TD-139-60 manufactured by DIC Corporation, U-VAN 2020 manufactured by Mitsui Chemicals, Inc.), SUMITEX RESIN M-3 manufactured by Sumitomo Chemical Co., Ltd. and NIKALAC MW-30 manufactured by Nippon Carbide Industries Co., Inc.

After the synthesis of the melamine compounds (including multimers) or after the purchase of the commercially available melamine compounds (including multimers), the melamine compounds (including multimers) may be dissolved in an appropriate solvent such as toluene, xylene, or ethyl acetate, and may be washed with distilled water, ion-exchange water, or the like in order to eliminate the effect of a residual catalyst. Alternatively, the melamine compounds (including multimers) may be treated with an ion-exchange resin to remove the residual catalyst.

The melamine compounds may be used alone or in combination of two or more compounds.

The specific charge-transporting material will be described.

Examples of the specific charge-transporting material include compounds having at least one substituent (hereinafter, may be simply referred to as "specific reactive functional group") selected from —OH, —$OCH_3$, —$NH_2$, —SH, and —COOH. In particular, the specific charge-transporting material is preferably a compound having at least two substituents selected from the above specific reactive functional groups, and more preferably a compound having three substituents selected from the above specific reactive functional groups.

The specific charge-transporting material may be a compound represented by general formula (I) below.

$$F—((—R^1—X)_{n1}(R^2)_{n3}—Y)_{n2} \quad (I)$$

In general formula (I), F represents an organic group derived from a compound having a hole-transporting capability, $R^1$ and $R^2$ each independently represent a linear or branched alkylene group having 1 to 5 carbon atoms, n1 represents 0 or 1, n2 represents an integer of 1 to 4, and n3 represents 0 or 1, X represents an oxygen atom, NH, or a sulfur atom, and Y represents —OH, —$OCH_3$, —$NH_2$, —SH, or —COOH (i.e., the above specific reactive functional group).

In general formula (I), the compound having a hole-transporting capability from which the organic group represented by F is derived is preferably an arylamine derivative. Examples of the arylamine derivative include triphenylamine derivatives and tetraphenylbenzidine derivatives.

The compound represented by general formula (I) is preferably a compound represented by general formula (II) below.

(II)

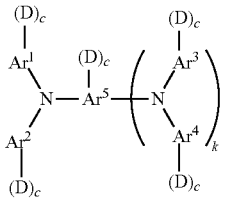

In general formula (II), $Ar^1$ to $Ar^4$ may be the same or different, and each independently represent a substituted or unsubstituted aryl group, $Ar^5$ represents a substituted or unsubstituted aryl group or a substituted or unsubstituted arylene group, each D independently represents —(—$R^1$—X)$_{n1}$($R^2$)$_{n3}$—Y (where $R^1$ and $R^2$ each independently represent a linear or branched alkylene group having 1 to 5 carbon atoms, n1 represents 0 or 1, n3 represents 0 or 1, X represents an oxygen atom, NH, or a sulfur atom, and Y represents —OH, —$OCH_3$, —$NH_2$, —SH, or —COOH), each c independently represents 0 or 1, k represents 0 or 1, and the total number of D is 1 or more and 4 or less.

In general formula (II), "—(—$R^1$—X)$_{n1}$($R^2$)$_{n3}$—Y" represented by D has the same definitions as in general formula (I), and $R^1$ and $R^2$ each independently represents a linear or branched alkylene group having 1 to 5 carbon atoms. Furthermore, n1 is preferably 1, X is preferably an oxygen atom, and Y is preferably a hydroxyl group.

In general formula (II), the total number of D corresponds to n2 in general formula (I), and is preferably 2 or more and 4 or less, and more preferably 3 or more and 4 or less. Specifically, the compounds represented by general formulae (I) and (II) preferably have 2 or more and 4 or less of the specific reactive functional groups per molecule, and more preferably 3 or more and 4 or less of the specific reactive functional groups per molecule.

In general formula (II), each of $Ar^1$ to $Ar^4$ is preferably any one of groups represented by formulae (1) to (7) below. Note that formulae (1) to (7) are shown together with "-$(D)_c$", which may be bonded to each of $Ar^1$ to $Ar^4$.

(1)

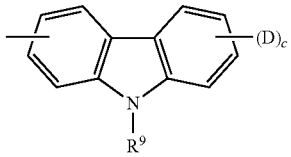

(2)

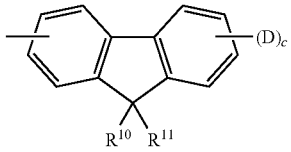

(3)

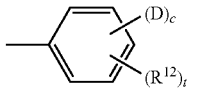

(4)

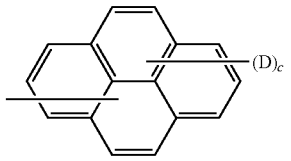

(5)

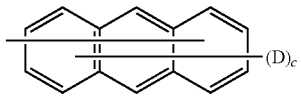

(6)

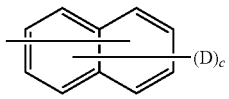

(7)

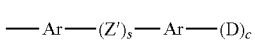

In formulae (1) and (7), $R^9$ represents one selected from a hydrogen atom, an alkyl group having 1 to 4 carbon atoms, a phenyl group substituted by an alkyl group having 1 to 4 carbon atoms or by an alkoxy group having 1 to 4 carbon atoms, an unsubstituted phenyl group, and an aralkyl group having 7 to 10 carbon atoms; $R^{10}$ to $R^{12}$ each independently represent one selected from a hydrogen atom, an alkyl group having 1 to 4 carbon atoms, an alkoxy group having 1 to 4 carbon atoms, a phenyl group substituted by an alkoxy group having 1 to 4 carbon atoms, an unsubstituted phenyl group, an aralkyl group having 7 to 10 carbon atoms, and a halogen atom; Ar represents a substituted or unsubstituted arylene group; D and c are respectively defined in the same manner as "D" and "c" in general formula (II); s represents 0 or 1; and t represents an integer of 1 to 3.

In formula (7), each of Ar is preferably a group represented by formula (8) or (9) below.

(8)

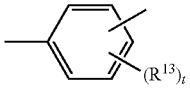

(9)

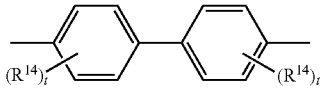

In formulae (8) and (9), $R^{13}$ and $R^{14}$s each independently represent one selected from a hydrogen atom, an alkyl group having 1 to 4 carbon atoms, an alkoxy group having 1 to 4 carbon atoms, a phenyl group substituted by an alkoxy group having 1 to 4 carbon atoms, an unsubstituted phenyl group, an aralkyl group having 7 to 10 carbon atoms, and a halogen atom; and each t independently represents an integer of 1 to 3.

In formula (7), Z' is preferably a group represented by any one of formulae (10) to (17) below.

(10)

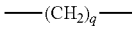

(11)

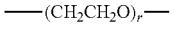

(12)

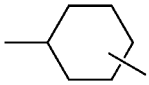

(13)

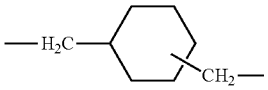

(14)

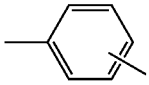

(15)

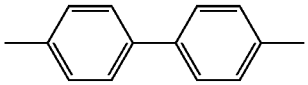

(16)

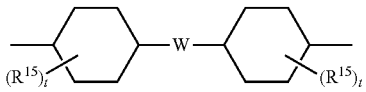

-continued (17)

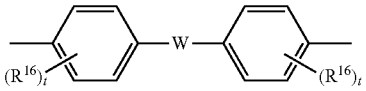

In formulae (10) to (17), $R^{15}$s and $R^{16}$s each independently represent one selected from a hydrogen atom, an alkyl group having 1 to 4 carbon atoms, a phenyl group substituted by an alkyl group having 1 to 4 carbon atoms or by an alkoxy group having 1 to 4 carbon atoms, an unsubstituted phenyl group, an aralkyl group having 7 to 10 carbon atoms, and a halogen atom; W represents a divalent group; q and r each independently represent an integer of 1 to 10; and each t independently represents an integer of 1 to 3.

In formulae (16) and (17), W is preferably any one of the divalent groups represented by formulae (18) to (26) below. In formula (25), u represents an integer of 0 to 3.

(18)

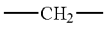

(19)

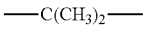

(20)

(21)

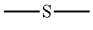

(22)

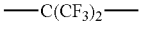

(23)

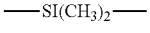

(24)

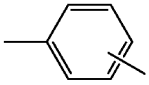

(25)

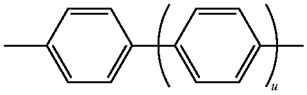

(26)

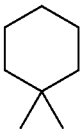

In general formula (II), when k is 0, $Ar^5$ is preferably an aryl group represented by any one of formulae (1) to (7) exemplified in the description of $Ar^1$ to $Ar^4$. In general formula (II), when k is 1, $Ar^5$ is preferably an arylene group obtained by removing one hydrogen atom from an aryl group represented by any one of formulae (1) to (7) above.

Fluorocarbon resin particles will now be described.

The fluorocarbon resin particles are not particularly limited. For example, at least one selected from polytetrafluoroethylene (PTFE), polychlorotrifluoroethylene, polyhexafluoropropylene, polyvinyl fluoride, polyvinylidene fluoride, polydichlorodifluoroethylene, and copolymers thereof is preferable. Polytetrafluoroethylene and polyvinylidene fluoride are more preferable, and polytetrafluoroethylene is particularly preferable.

The fluorocarbon resin particles preferably have an average primary particle size of 0.05 μm or more and 1 μm or less or about 0.05 μm or more and about 1 μm or less, and more preferably 0.1 μm or more and 0.5 μm or less. When the average primary particle size of the fluorocarbon resin particles is less than 0.05 μm or less than about 0.05 μm, it is difficult to obtain the effect of the addition of the fluorocarbon resin particles. An average primary particle size of the fluorocarbon resin particles of more than 1 μm or more than about 1 μm is not preferable because an adverse effect of the fluorocarbon resin particles tends to appear on an image.

The term "average primary particle size of fluorocarbon resin particles" refers to a value determined by performing measurement of a measurement solution, which is prepared by diluting a dispersion liquid of the fluorocarbon resin particles with the same solvent as the solvent of the dispersion liquid, using a laser diffraction particle size distribution analyzer LA-920 (manufactured by HORIBA, Ltd.) at a refractive index of 1.35.

The content of the fluorocarbon resin particles (the content of the fluorocarbon resin particles relative to the total solid content of the protective layer) is, for example, preferably 1% by mass or more and 30% by mass or less or about 1% by mass or more and about 30% by mass or less, and more preferably 2% by mass or more and 20% by mass or less. When the content of the fluorocarbon resin particles is increased, the effect of causing frictional electrification of an external additive is improved. However, light scattering tends to occur in the protective layer, reproducibility of lines and characters decreases, and granularity also tends to decrease. For this reason, the content of the fluorocarbon resin particles is preferably in the above range.

In order to improve dispersibility of the fluorocarbon resin particles, a fluorine-containing dispersant may be used in combination. An example of the fluorine-containing dispersant is a fluorinated alkyl group-containing copolymer.

The fluorinated alkyl group-containing copolymer is not particularly limited, but preferably a fluorine-containing graft polymer having repeating units represented by structural formulae (1) and (2) below. The fluorinated alkyl group-containing copolymer is preferably a resin synthesized by, for example, graft-polymerizing a macromonomer composed of an acrylic acid ester compound, a methacrylic acid ester compound, or the like and a perfluoroalkylethyl(meth)acrylate or a perfluoroalkyl(meth)acrylate. Herein, the term "(meth)acrylate" refers to acrylate or methacrylate.

Structural formula (1)

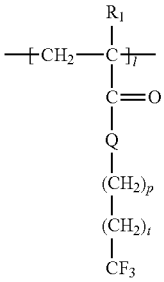

-continued

Structural formula (2)

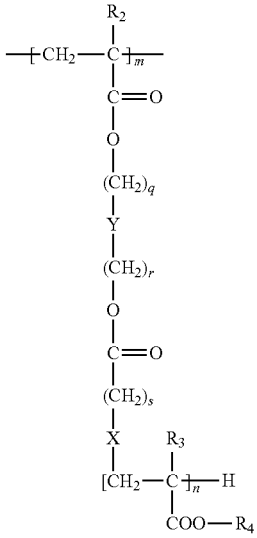

In structural formulae (1) and (2), l, m, and n each independently represent an integer of 1 or more; p, q, r, and s each independently represent an integer of 0 or 1 or more; t represents an integer of 1 to 7; $R_1$, $R_2$, $R_3$, and $R_4$ each independently represent a hydrogen atom or an alkyl group; X represents an alkylene chain, a halogen-substituted alkylene chain, —S—, —O—, —NH—, or a single bond; Y represents an alkylene chain, a halogen-substituted alkylene chain, —($C_zH_{2z-1}$(OH))— (wherein z represents an integer of 1 or more), or a single bond; and Q represents —O— or —NH—.

The fluorinated alkyl group-containing copolymer preferably has a weight-average molecular weight of 10,000 or more and 100,000 or less, and more preferably 30,000 or more and 100,000 or less.

In the fluorinated alkyl group-containing copolymer, a content ratio of the repeating unit represented by structural formula (1) to the repeating unit represented by structural formula (2), i.e., 1:m is preferably 1:9 to 9:1, and more preferably 3:7 to 7:3.

In structural formulae (1) and (2), examples of the alkyl group represented by $R_1$, $R_2$, $R_3$, and $R_4$ include a methyl group, an ethyl group, and a propyl group. $R_1$, $R_2$, $R_3$, and $R_4$ are each preferably a hydrogen atom or a methyl group. Among these, a methyl group is more preferable.

The fluorinated alkyl group-containing copolymer may further contain a repeating unit represented by structural formula (3). As for the content of the repeating unit represented by structural formula (3), a ratio ((l+m):z) of the sum (l+m) of the content of the repeating unit represented by structural formula (1) and the content of the repeating unit represented by structural formula (2) to the content (z) of the repeating unit represented by structural formula (3) is preferably (l+m):z=10:0 to 7:3, and more preferably 9:1 to 7:3.

Structural formula (3)

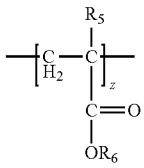

In structural formula (3), $R_5$ and $R_6$ each independently represent a hydrogen atom or an alkyl group, and z represents an integer of 1 or more.

$R_5$ and $R_6$ are each preferably a hydrogen atom, a methyl group, or an ethyl group. Among these, a methyl group is more preferable.

The content of the fluorinated alkyl group-containing copolymer is preferably 1% by mass or more and 10% by mass or less relative to the mass of the fluorocarbon resin particles.

Other additives will be described.

The protective layer may contain a surfactant, an antioxidant, a curing catalyst, and other additives.

The thickness of the protective layer is preferably 1 μm or more and 25 μm or less, and more preferably 2 μm or more and 10 μm or less.

As the electrophotographic photoreceptor 10, an exemplary embodiment has been described in which the protective layer constituting the top surface layer is a cured film containing fluorocarbon resin particles. However, the structure of the electrophotographic photoreceptor 10 is not limited thereto. For example, when the protective layer is not provided and the charge transport layer or the single-layer photosensitive layer constitutes the top surface layer, the charge transport layer or the single-layer photosensitive layer may be constituted by a cured film containing fluorocarbon resin particles.

(Charging Device)

Examples of the charging device 20 include contact-type charging devices using a conductive charging roller, charging brush, charging film, charging rubber blade, charging tube, or the like. Examples of the charging device 20 further include a non-contact-type roller charging device, and known charging devices such as a scorotron charging device and a corotron charging device that utilize corona discharge. The charging device 20 is preferably a contact-type charging device.

In the system of the present exemplary embodiment, discharge products are easily produced even when a charging device that applies a voltage obtained by superimposing an AC voltage on a DC voltage is used. However, even when such a system is used, adhesion and deposition of the discharge products on the electrophotographic photoreceptor 10 are suppressed, thereby suppressing print defects in terms of image density.

(Exposure Device)

An example of the exposure device 30 is an optical instrument that irradiates the surface of the electrophotographic photoreceptor 10 with light such as a semiconductor laser beam, an LED beam, or light through a liquid crystal shutter so as to form a desired image. The wavelength of the light source may be within a spectral sensitivity range of the electrophotographic photoreceptor 10. The wavelength of the semiconductor laser may be within a near-infrared range having an oscillation wavelength at around 780 nm. However, the oscillation wavelength of the semiconductor laser is not limited to this range. Lasers having an oscillation wavelength on the order of 600 nm and blue lasers having an oscillation wavelength of 400 nm or more and 450 nm or less may also be used. Furthermore, for example, a surface-emitting laser light source capable of multibeam output is also useful as the exposure device 30 for the purpose of forming a color image.

(Transfer Device)

Examples of the first transfer device 51 and the second transfer device 57 include contact-type transfer-charging devices using a belt, a roller, a film, a rubber blade, or the like, and known transfer-charging devices such as a scorotron transfer-charging device and a corotron transfer-charging device that utilize corona discharge.

(Drum-Cleaning Device)

The drum-cleaning device 60 includes a housing 61 and a cleaning blade 62 arranged so as to protrude from the housing 61.

The cleaning blade 62 may be supported on an edge of the housing 61. Alternatively, the cleaning blade 62 may be separately supported by a supporting member (holder). The present exemplary embodiment describes a cleaning blade supported on an edge of the housing 61.

The cleaning blade 62 will be described.

The cleaning blade 62 is a plate-shaped member extending in a direction of the rotation axis of the electrophotographic photoreceptor 10. The cleaning blade 62 is arranged on the upstream side of the rotation direction of the electrophotographic photoreceptor 10 (shown by arrow A) so that an edge of the cleaning blade 62 contacts the electrophotographic photoreceptor 10 while applying a pressure.

Examples of the material of the cleaning blade 62 include urethane rubber, silicone rubber, fluororubber, chloroprene rubber, and butadiene rubber. Among these, urethane rubber is preferable.

The materials of the urethane rubber (polyurethane) are not particularly limited as long as, for example, the materials are usually used for forming polyurethanes. For example, a urethane prepolymer obtained from a polyol such as a polyester polyol derived from polyethylene adipate or polycaprolactone and an isocyanate such as diphenylmethane diisocyanate; and a crosslinking agent such as 1,4-butanediol, trimethylolpropane, ethylene glycol, or a mixture thereof may be used as the materials.

Next, an imaging process (a method for forming an image) using the image forming apparatus 1 according to the present exemplary embodiment will be described.

As illustrated in FIG. 1, in the image forming apparatus 1 according to the present exemplary embodiment, first, the electrophotographic photoreceptor 10 rotates in the direction shown by arrow A, and the charging device 20 charges a surface of the electrophotographic photoreceptor 10 so that the surface has a desired polarity (negative polarity in the exemplary embodiment) and a desired potential. Subsequently, the exposure device 30 radiates light LB on the charged surface of the electrophotographic photoreceptor 10, the light LB being emitted on the basis of information (signal) of an image input to the image forming apparatus 1, to form an electrostatic latent image with a predetermined potential difference on the surface.

Subsequently, the developing device 40 conducts development by bringing a magnetic brush of a developer carried on a surface of the developing roller 42 into contact with the electrostatic latent image formed on the surface of the electrophotographic photoreceptor 10. The electrostatic latent image formed on the electrophotographic photoreceptor 10 is visualized by this development as a toner image developed with a toner.

Subsequently, when the toner image formed on the electrophotographic photoreceptor 10 is transported to the first transfer position, the first transfer device 51 performs a first transfer of the toner image to the intermediate transfer belt 52 of the intermediate transfer device 50, the intermediate transfer belt 52 rotating in the direction shown by arrow B.

Subsequently, in the intermediate transfer device 50, the toner image that has been subjected to the first transfer is carried and transported to the second transfer position by the rotation of the intermediate transfer belt 52. In the paper feeding device 70, predetermined recording paper P is sent to the paper feed transport path in accordance with the image-forming operation on the surface of the electrophotographic photoreceptor 10. In the paper feed transport path, a pair of paper transport rollers (not shown) functioning as resist rollers sends and supplies the recording paper P to the second transfer position in accordance with the transfer timing.

At the second transfer position, the second transfer device 57 performs a second transfer of the toner image on the intermediate transfer belt 52 to the recording paper P. In the intermediate transfer device 50 after the completion of the second transfer, the belt cleaning device 58 removes adhering matter such as a toner that remains on the surface of the intermediate transfer belt 52 after the second transfer to clean the intermediate transfer belt 52.

Subsequently, the recording paper P that has been subjected to the second transfer of the toner image is separated from the intermediate transfer belt 52 and the second transfer device 57 and is then transported to the fixing device 80 by the paper transport device 83. In the fixing device 80, the recording paper P after the second transfer is introduced and passed through the contact portion between the rotating heating rotary member 81 and pressure rotary member 82. Thus, a necessary fixing treatment (heating and pressing) is performed to fix the unfixed toner image to the recording paper P. In the case of an image forming operation in which an image is formed only on the one surface of the recording paper P, lastly, the recording paper P after the completion of the fixing is discharged by a pair of paper discharge rollers (not shown) toward, for example, a discharge storage unit (not shown) arranged on the outside of the image forming apparatus 1.

The recording paper P having an image thereon is output through the above operations.

In this process, after the toner image is transferred to the intermediate transfer device 50, the toner and discharge products remaining on the surface of the electrophotographic photoreceptor 10 are removed by the cleaning blade 62 of the drum-cleaning device 60. The electrophotographic photoreceptor 10, from which the toner and the discharge products remaining after the transfer have been removed by the drum-cleaning device 60, is charged again by the charging device 20 and exposed by the exposure device 30. Thus, a latent image is again formed on the electrophotographic photoreceptor 10.

Alternatively, for example, as illustrated in FIG. 1, the image forming apparatus 1 according to the present exemplary embodiment may include a process cartridge 1*a* in which the electrophotographic photoreceptor 10, the charging device 20, the developing device 40, and the drum-cleaning device 60 are integrally arranged in a housing 11. This process cartridge 1*a* integrally contains plural members therein, and is attached to or detached from the image forming apparatus 1. The image forming apparatus 1 illustrated in FIG. 1 shows an exemplary embodiment in which the developing device 40 does not include a supplemental developer container.

The structure of the process cartridge 1*a* is not particularly limited as long as the process cartridge 1*a* includes at least the electrophotographic photoreceptor 10, the developing device 40, and the drum-cleaning device 60. The process cartridge 1*a* may further include, for example, at least one device selected from the charging device 20, the exposure device 30, and the first transfer device 51.

The structure of the image forming apparatus 1 according to the present exemplary embodiment is not limited to the above structure. For example, a first charge-erasing device for making the polarity of the remaining toner uniform so that the remaining toner is easily removed by a cleaning brush or the like may be provided around the electrophotographic photoreceptor 10 and on the downstream side of the first transfer device 51 in the rotation direction of the electrophotographic photoreceptor 10 and on the upstream side of the drum-cleaning device 60 in the rotation direction of the electrophotographic photoreceptor 10. A second charge-erasing device for erasing charge on the surface of the electrophotographic photoreceptor 10 may be provided around the electrophotographic photoreceptor 10 and on the downstream side of the drum-cleaning device 60 in the rotation direction of the electrophotographic photoreceptor 10 and on the upstream side of the charging device 20 in the rotation direction of the electrophotographic photoreceptor 10.

The structure of the image forming apparatus 1 according to the present exemplary embodiment is not limited to the above structure and may have a known structure. For example, a system in which a toner image formed on the electrophotographic photoreceptor 10 is directly transferred to recording paper P may be employed, or a tandem-system image forming apparatus may be employed.

Second Exemplary Embodiment

Figure 2:
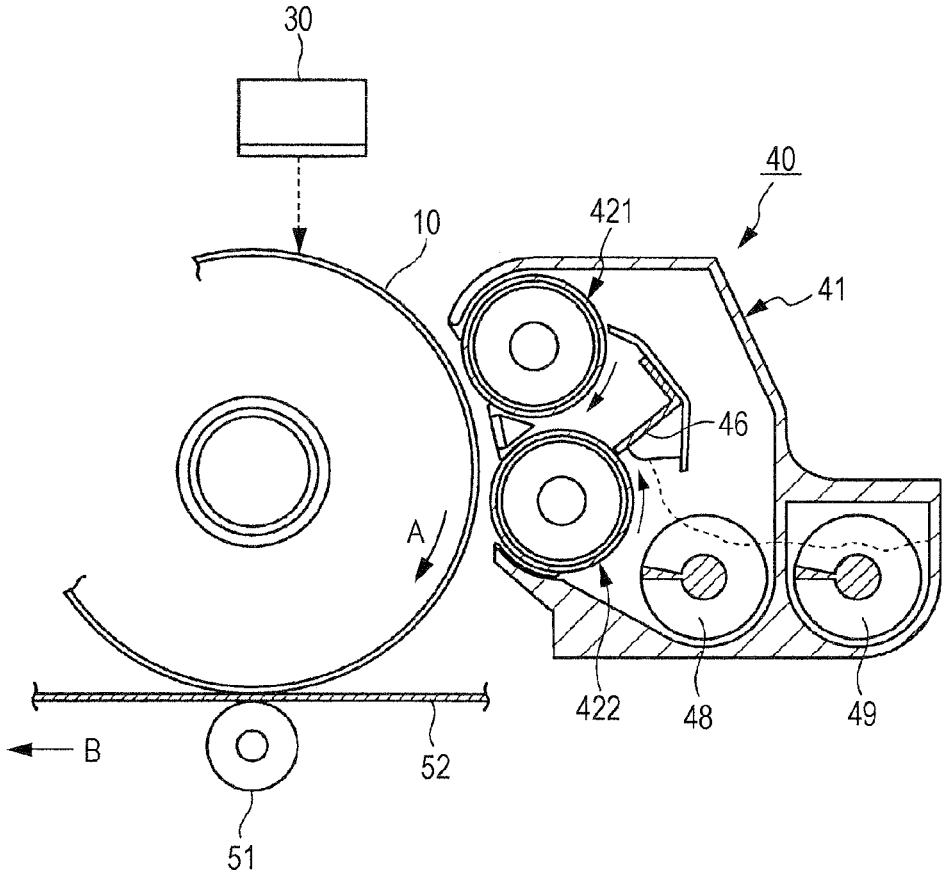
FIG. 2 is a structural view illustrating an image forming apparatus according to a second exemplary embodiment of the present invention.

FIG. 2 illustrates the relevant part of an image forming apparatus according to a second exemplary embodiment of the present invention.

A developing device 40 of this image forming apparatus includes a first developing roller 421 functioning as a first developer-carrying member and a second developing roller 422 functioning as a second developer-carrying member for the purpose of further improving the developability. The first developing roller 421 moves in a direction opposite to a moving direction of the surface of an electrophotographic photoreceptor 10 in a portion facing the electrophotographic photoreceptor 10. The second developing roller 422 is arranged on the downstream side of the first developing roller 421 in the moving direction of the electrophotographic photoreceptor 10 and moves in the same direction as the moving direction of the surface of the electrophotographic photoreceptor 10 in a portion facing the electrophotographic photoreceptor 10.

In the second exemplary embodiment, as illustrated in FIG. 2, a layer-thickness control member 46 is arranged so as to face the surface of the second developing roller 422 with a predetermined gap therebetween. A developer supplied to the surface of the second developing roller 422 while the layer thickness thereof is controlled is separated into the developer on the first developing roller 421 and the developer on the second developing roller 422 at a position at which the first developing roller 421 and the second developing roller 422 face each other. The developer on the first developing roller 421 and the developer on the second developing roller 422 are transported to developing regions with the rotations of the first developing roller 421 and the second developing roller 422, respectively.

In order to suppress the adhesion of an external additive to the surface of the electrophotographic photoreceptor 10, the developing device 40 is configured so that a development condition of the first developing roller 421 is lower than that of the second developing roller 422.

As described above, parameters representing the contact state of a developer in a developing region include a shortest distance between the electrophotographic photoreceptor 10 and the developing roller 42 and the amount of developer per unit area carried on the developing roller 42 in the developing region.

In the first developing roller 421, the value of MOS/DRS is set to be smaller than a reference value. On the other hand, in the second developing roller 422, the value of MOS/DRS is set to be larger than the reference value.

By making the development condition of the first developing roller 421 lower than that of the second developing roller 422 in this manner, the developability may be improved while suppressing the adhesion of an external additive to the surface of the electrophotographic photoreceptor 10.

Instead of changing the value of MOS/DRS, the number of rotations of the first developing roller 421 may be set to be smaller than a reference value, and the number of rotations of the second developing roller 422 may be set to be larger than the reference value.

EXAMPLES

The present invention will now be specifically described by way of Examples. However, the invention is not limited to these Examples. In Examples below, "part" means part by mass.

Example 1

Preparation of Electrophotographic Photoreceptor 1

(Formation of Undercoat Layer)

First, 100 parts by mass of zinc oxide (average particle size: 70 nm, manufactured by TAYCA CORPORATION, specific surface area: 15 $m^2/g$) is mixed with 500 parts by mass of toluene while stirring, 1.3 parts by mass of a silane coupling agent (KBM503, manufactured by Shin-Etsu Chemical Co., Ltd.) is added thereto, and the mixture is stirred for two hours. The toluene is then distilled off under reduced pressure, and the resulting product is baked at 120° C. for three hours to prepare silane coupling agent-surface-treated zinc oxide particles.

A solution is prepared by dissolving 60 parts by mass of the surface-treated zinc oxide particles, 0.6 parts by mass of alizarin, 13.5 parts by mass of a curing agent (blocked isocyanate, Sumidur 3175 manufactured by Sumitomo Bayer Urethane Co., Ltd.), and 15 parts by mass of a butyral resin (S-LEC BM-1, manufactured by Sekisui Chemical Co., Ltd.) in 85 parts by mass of methyl ethyl ketone. Next, 38 parts by mass of this solution is mixed with 25 parts by mass of methyl ethyl ketone. The mixture is dispersed for two hours using glass beads having a diameter ϕ of 1 mm with a sand mill to prepare a dispersion liquid.

Next, 0.005 parts by mass of dioctyltin dilaurate functioning as a catalyst and 40 parts by mass of silicone resin particles (Tospearl 145, manufactured by GE Toshiba Silicones Co., Ltd.) are added to the dispersion liquid to prepare a coating liquid for forming an undercoat layer. This coating liquid is applied onto an aluminum base having a diameter of 30 mm by dip coating, and cured by drying at 170° C. for 40 minutes to form an undercoat layer having a thickness of 19 μm.

(Formation of Charge Generation Layer)

A mixture containing 15 parts by mass of hydroxygallium phthalocyanine (charge-generating material) having diffraction peaks at Bragg angles (2θ±0.2° of at least 7.3°, 16.0°, 24.9°, and 28.0° in an X-ray diffraction spectrum obtained by using CuKα characteristic X-rays, 10 parts by mass of a vinyl chloride-vinyl acetate copolymer (binder resin) (VMCH, manufactured by Nippon Unicar Company Limited), and 200 parts by mass of n-butyl acetate is dispersed using glass beads having a diameter ϕ of 1 mm with a sand mill for four hours. Next, 175 parts by mass of n-butyl acetate and 180 parts by mass of methyl ethyl ketone are added to the dispersion liquid, and the mixture is stirred to prepare a coating liquid for forming a charge generation layer. This coating liquid for forming a charge generation layer is applied onto the undercoat layer by dip coating, and dried at room temperature (25° C.) to form a charge generation layer having a thickness of 0.2 μm.

(Formation of Charge Transport Layer)

First, 45 parts by mass of N,N'-diphenyl-N,N'-bis(3-methylphenyl)-[1,1']biphenyl-4,4'-diamine and 55 parts by mass of a bisphenol Z polycarbonate resin (viscosity-average molecular weight: 50,000) are added to 800 parts by mass of chlorobenzene and dissolved therein to prepare a coating liquid for forming a charge transport layer. This coating liquid is applied onto the charge generation layer, and dried at 130° C. for 45 minutes to form a charge transport layer having a thickness of 20 μm.

(Formation of Protective Layer)

Five parts by mass of polytetrafluoroethylene particles (Lubron L-2, manufactured by Daikin Industries, Ltd.) and 0.25 parts by mass of a fluorinated alkyl group-containing copolymer having repeating units represented by structural formula (4) below (weight-average molecular weight: 50,000, l:m=1:1, s=1, and n=60) are sufficiently mixed with 17 parts by mass of cyclopentanone (alicyclic ketone compound) while stirring to prepare a suspension of the polytetrafluoroethylene particles.

Structural formula (4)

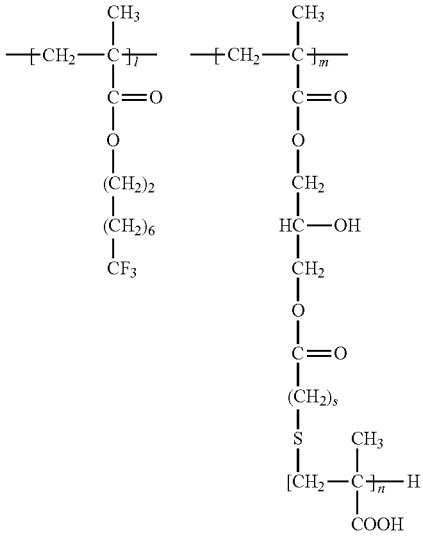

Next, 5 parts by mass of a melamine compound represented by formula (AM-1) below, and 95 parts by mass of a compound functioning as a charge-transporting material and represented by formula (I-1) below are added to 220 parts by mass of cyclopentanone, and sufficiently mixed and dissolved. The suspension of the polytetrafluoroethylene particles is then added thereto, and the mixture is mixed under stirring. A dispersion treatment at an increased pressure of 700 $kgf/cm^2$ is then repeated 20 times using a high-pressure homogenizer equipped with a flow-through chamber having a fine flow path (YSNM-1500AR, manufactured by Yoshida Kikai Co., Ltd.). Subsequently, 0.2 parts by mass of a NACURE5225 (manufactured by King Industries Inc.) is added as a catalyst to prepare a coating liquid for forming a protective layer. This coating liquid is applied onto the charge transport layer by ring dip coating, and cured by heating at 150° C. for one hour to form a protective layer having a thickness of 4 μm. Thus, an electrophotographic photoreceptor 1 is prepared.

(I-1)

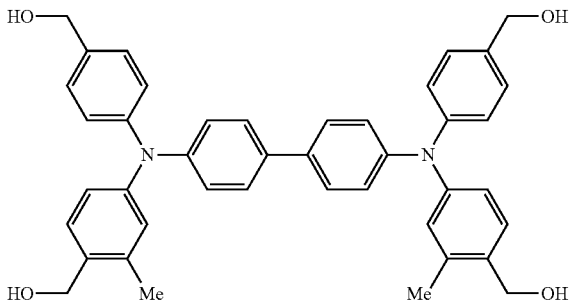

(AM-1)

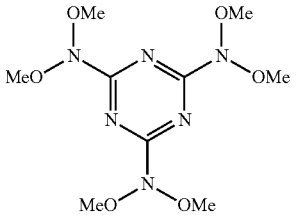

Preparation of Toner 1

(Preparation of Polyester Resin Dispersion Liquid)

| | |
|---|---|
| Terephthalic acid | 30% by mole |
| Fumaric acid | 70% by mole |
| Bisphenol A ethylene oxide 2-mole adduct | 20% by mole |
| Bisphenol A propylene oxide 2-mole adduct | 80% by mole |

The above components are put in a 5-L flask equipped with a stirrer, a nitrogen inlet tube, a temperature sensor, and a rectifying column, and the temperature is increased to 190° C. over a period of one hour. Stirring of the reaction system is confirmed, and 1.2 parts by mass of dibutyltin oxide is then added thereto.

The temperature is further increased from 190° C. to 240° C. over a period of six hours while distilling off water produced, and a dehydration-condensation reaction is further continued at 240° C. for three hours. Thus, an amorphous polyester resin 1 having an acid value of 12.0 mg/KOH, and a weight-average molecular weight of 9,700 is obtained.

Subsequently, the amorphous polyester resin 1 is transported to a Cavitron CD1010 (manufactured by Eurotec Ltd.) at a rate of 100 g/min while maintaining the molten state.

A 0.37 mass % dilute aqueous ammonia prepared by diluting an aqueous ammonia reagent with ion-exchange water is put in an aqueous medium tank that is separately prepared. The diluted aqueous ammonia is transported to the Cavitron CD1010 (manufactured by Eurotec Ltd.) while being heated at 120° C. with a heat exchanger at a rate of 0.1 L/min at the same time of the transportation of the above molten amorphous polyester resin 1.

The Cavitron is operated under the conditions of a rotation speed of a rotator of 60 Hz and a pressure of 5 kg/cm$^2$, thus preparing a resin dispersion liquid that contains polyester resin particles having an average particle size of 0.16 μm and that has a solid content of 30 parts by mass.

(Preparation of Colorant Dispersion Liquid)

| | |
|---|---|
| Cyan pigment (Copper phthalocyanine B15: 3, manufactured by Dainichiseika Color & Chemicals Mfg. Co., Ltd.) | 45 parts by mass |
| Ionic surfactant Neogen RK (manufactured by Dai-ichi Kogyo Seiyaku Co., Ltd.) | 5 parts by mass |
| Ion-exchange water | 200 parts by mass |

The above components are mixed and dissolved, and dispersed for 10 minutes with a homogenizer (IKA Ultra-Turrax) to prepare a colorant dispersion liquid that contains a colorant having a median particle size of 168 nm and that has a solid content of 22.0 parts by mass.

(Preparation of Release Agent Dispersion Liquid)

| | |
|---|---|
| Paraffin wax HNP9 (melting point: 75° C., manufactured by Nippon Seiro Co., Ltd.) | 45 parts by mass |
| Cationic surfactant Neogen RK (manufactured by Dai-ichi Kogyo Seiyaku Co., Ltd.) | 5 parts by mass |
| Ion-exchange water | 200 parts by mass |

The above components are heated to 95° C., and dispersed using Ultra-Turrax T50 manufactured by IKA. A dispersion treatment is then conducted with a pressure discharging-type Gaulin homogenizer to prepare a release agent dispersion liquid that contains a release agent having a median size of 200 nm and that has a solid content of 20.0 parts by mass.

(Preparation of Toner Particles)

| | |
|---|---|
| Polyester resin dispersion liquid | 278.9 parts by mass |
| Colorant dispersion liquid | 27.3 parts by mass |
| Release agent dispersion liquid | 35 parts by mass |

The above dispersion liquids are mixed and dispersed in a round stainless flask using Ultra-Turrax T50. Next, 0.20 parts by mass of polyaluminum chloride is added thereto, the dispersion operation is continued with the Ultra-Turrax. The flask is heated to 48° C. in an oil bath for heating while stirring. The temperature is maintained at 48° C. for 60 minutes, and 70.0 parts by mass of the resin dispersion liquid is then further added to the flask.

Subsequently, the pH in the reaction system is adjusted to be 9.0 with a 0.5 mol/L aqueous sodium hydroxide solution. The stainless flask is then sealed, and heated to 96° C. while the stirring is continued using a magnetic seal. The flask is maintained in this state for five hours.

After the completion of the reaction, the product in the flask is cooled, filtered, and washed with ion-exchange water. The product is then subjected to solid-liquid separation by Nutsche suction filtration. The solid is further re-dispersed in 1 L of ion-exchange water at 40° C., and the resulting dispersion liquid is stirred at 300 rpm for 15 minutes for washing.

The above operation is further repeated five times. When the pH of the filtrate becomes 7.5 and the electrical conductivity of the filtrate becomes 7.0 μS/cm, solid-liquid separation is conducted by Nutsche suction filtration using No. 5A filter paper. Vacuum drying is then continued for 12 hours.

The particle size of the prepared particles is measured with a Coulter Multisizer. The volume-average particle size D50 is 4.8 μm, and the particle size distribution index GSD is 1.14. The shape factor of the toner particles determined by a particle shape observation with a LUZEX is 0.970.

(Preparation of External Additive 1)

[Granulation Step]

Alkali catalyst solution preparation step (Preparation of alkali catalyst solution (1))

In a 3-L glass reaction container equipped with a metal stirring rod, a dropping nozzle (microtube pump composed of Teflon (registered trademark)), and a thermometer, 157.9 parts of methanol and 25.89 parts of a 10% aqueous ammonia are put, and mixed while stirring to prepare an alkali catalyst solution (1).

Particle generation step (Preparation of silica particle suspension)

Next, the temperature of the alkali catalyst solution (1) is adjusted to 47° C., and the alkali catalyst solution (1) is purged with nitrogen. Subsequently, 28.73 parts of tetramethoxysilane (TMOS) and aqueous ammonia having a catalyst ($NH_3$) concentration of 3.8% are added dropwise to the alkali catalyst solution (1) at the same time at the rates described below while stirring the alkali catalyst solution (1). Thus, a suspension of silica particles (silica particle suspension (1)) is prepared.

In this step, the tetramethoxysilane (TMOS) is supplied at a rate of 5.27 parts/min, and the 3.8% aqueous ammonia is supplied at a rate of 3.18 parts/min.

The volume-average particle size ($D50_v$) of the particles in the silica particle suspension (1) is measured with the particle size analyzer described above. The volume-average particle size ($D50_v$) is 118 nm.

[Drying Step]

Next, the prepared suspension of hydrophilic silica particles (hydrophilic silica particle dispersion liquid) is spray-dried to remove the solvent. Thus, a powder of hydrophilic silica particles is prepared.

[Hydrophobizing Treatment Step]

Next, 100 parts of the powder of the hydrophilic silica particles is put in a mixer, and stirred at 200 rpm while being heated at 200° C. in a nitrogen atmosphere. Furthermore, 30 parts of hexamethyldisilazane (HMDS) is added dropwise to the powder of the hydrophilic silica particles and allowed to react for two hours. The powder is then cooled to prepare a powder of hydrophobic silica particles that has been subjected to a hydrophobizing treatment. The prepared hydrophobic silica particles (1) are added to resin particles having a particle size of 100 μm, and SEM photographs of 100 primary particles of the hydrophobic silica particles (1) are taken. Next, image analysis of the SEM photographs is conducted. According to the results, the primary particles of the hydrophobic silica particles (1) have an average circularity of 0.78.

(Preparation of External Additive 2)

[Granulation Step]

Alkali catalyst solution preparation step (Preparation of alkali catalyst solution (2))

In a 3-L glass reaction container equipped with a metal stirring rod, a dropping nozzle (microtube pump composed of Teflon (registered trademark)), and a thermometer, 157.9 parts of methanol and 25.1 parts of a 10% aqueous ammonia are put, and mixed while stirring to prepare an alkali catalyst solution (2).

Particle generation step (Preparation of silica particle suspension)

Next, the temperature of the alkali catalyst solution (2) is adjusted to 58° C., and the alkali catalyst solution (2) is purged with nitrogen. Subsequently, 28.73 parts of tetramethoxysilane (TMOS) and aqueous ammonia having a catalyst ($NH_3$) concentration of 3.8% are added dropwise to the alkali catalyst solution (2) at the same time at the rates described below while stirring the alkali catalyst solution (2). Thus, a suspension of silica particles (silica particle suspension (2)) is prepared.

In this step, the tetramethoxysilane (TMOS) is supplied at a rate of 6.4 parts/min, and the 3.8% aqueous ammonia is supplied at a rate of 3.18 parts/min.

The volume-average particle size ($D50_v$) of the particles in the silica particle suspension (2) is measured with the particle size analyzer described above. The volume-average particle size ($D50_v$) is 86 nm.

[Drying Step]

Next, the prepared suspension of hydrophilic silica particles (hydrophilic silica particle dispersion liquid) is spray-dried to remove the solvent. Thus, a powder of hydrophilic silica particles is prepared.

[Hydrophobizing Treatment Step]

Next, 100 parts of the powder of the hydrophilic silica particles is put in a mixer, and stirred at 200 rpm while being heated at 200° C. in a nitrogen atmosphere. Furthermore, 30 parts of hexamethyldisilazane (HMDS) is added dropwise to the powder of the hydrophilic silica particles and allowed to react for two hours. The powder is then cooled to prepare a powder of hydrophobic silica particles that has been subjected to a hydrophobizing treatment.

The prepared hydrophobic silica particles (2) are added to resin particles having a particle size of 100 μm, and SEM photographs of 100 primary particles of the hydrophobic silica particles (2) are taken. Next, image analysis of the SEM photographs is conducted. According to the results, the primary particles of the hydrophobic silica particles (2) have an average circularity of 0.75.

(Preparation of External Additive 3)

[Granulation Step]

Alkali catalyst solution preparation step (Preparation of alkali catalyst solution (3))

In a 3-L glass reaction container equipped with a metal stirring rod, a dropping nozzle (microtube pump composed of Teflon (registered trademark)), and a thermometer, 157.9 parts of methanol and 25.89 parts of a 10% aqueous ammonia are put, and mixed while stirring to prepare an alkali catalyst solution (3).

Particle generation step (Preparation of silica particle suspension)

Next, the temperature of the alkali catalyst solution (3) is adjusted to 45° C., and the alkali catalyst solution (3) is purged with nitrogen. Subsequently, 28.73 parts of tetramethoxysilane (TMOS) and aqueous ammonia having a catalyst ($NH_3$) concentration of 3.8% are added dropwise to the alkali catalyst solution (3) at the same time at the rates described below while stirring the alkali catalyst solution (3). Thus, a suspension of silica particles (silica particle suspension (3)) is prepared.

In this step, the tetramethoxysilane (TMOS) is supplied at a rate of 3.0 parts/min, and the 3.8% aqueous ammonia is supplied at a rate of 3.18 parts/min.

The volume-average particle size ($D50_v$) of the particles in the silica particle suspension (3) is measured with the particle size analyzer described above. The volume-average particle size ($D50_v$) is 122 nm.

[Drying Step]

Next, the prepared suspension of hydrophilic silica particles (hydrophilic silica particle dispersion liquid) is spray-dried to remove the solvent. Thus, a powder of hydrophilic silica particles is prepared.

[Hydrophobizing Treatment Step]

Next, 100 parts of the powder of the hydrophilic silica particles is put in a mixer, and stirred at 200 rpm while being heated at 200° C. in a nitrogen atmosphere. Furthermore, 30 parts of hexamethyldisilazane (HMDS) is added dropwise to the powder of the hydrophilic silica particles and allowed to react for two hours. The powder is then cooled to prepare a powder of hydrophobic silica particles that has been subjected to a hydrophobizing treatment.

The prepared hydrophobic silica particles (3) are added to resin particles having a particle size of 100 μm, and SEM photographs of 100 primary particles of the hydrophobic silica particles (3) are taken. Next, image analysis of the SEM photographs is conducted. According to the results, the primary particles of the hydrophobic silica particles (3) have an average circularity of 0.83

(Preparation of Toner)

To 100 parts by mass of the toner particles, 3 parts by mass of silica particles and 1 part by mass of titania particles (P25, manufactured by Nippon Aerosil Co., Ltd.) are added as external additives. The mixture is blended with a 5-L Henschel mixer at a peripheral velocity of 30 m/s for 15 minutes. Coarse particles are then removed with a sieve having openings of 45 μm to prepare toner 1.

Preparation of Carrier 1

| | |
|---|---|
| Polymethyl methacrylate (PMMA) resin (manufactured by Soken Chemical & Engineering Co., Ltd., Mw: 72,000, Mn: 36,000) | 3 parts by mass |
| Toluene (analytical grade) (manufactured by Wako Pure Chemical Industries Ltd.) | 30 parts by mass |
| Core material [magnetic powder manufactured by Powdertech Co., Ltd., Mn—Mg ferrite core (average particle size: 30 μm, saturation magnetization: 58 A · $m^2$/kg (at 1 kOe), true specific gravity: 4.6 g/$cm^3$)] | 100 parts by mass |

First, among the above components, the PMMA resin is dissolved in toluene to prepare a toluene solution of the PMMA resin. Next, the ferrite core (magnetic powder) used as a core material is put in a kneader heated at 80° C., and stirred. When the temperature of the ferrite core reaches 50° C., the toluene solution of the PMMA resin is put in the kneader. The kneader is sealed, and stirring is performed for 10 minutes.

Next, the atmosphere in the kneader is evacuated while maintaining stirring so as to evaporate toluene. Thirty minutes later, the vacuum is released, and the resulting powder is taken out from the kneader. The powder is left to cool to 30° C., and sieving is then performed with a sieve having openings of 45 μm, thus preparing carrier 1.

Preparation of Developer

Four parts of toner 1 and 96 parts of carrier 1 are stirred at 40 rpm for 20 minutes using a V-blender. Sieving is then performed with a sieve having openings of 250 μm, thus preparing a developer.

Evaluation

The electrophotographic photoreceptor and the developer are evaluated as follows.

The developer is housed in a developing device 40 of an image forming apparatus "modified ApeosPort C7780" (manufactured by Fuji Xerox Co., Ltd.). Images each having an area coverage of 5% are successively output on 1,000 sheets under the development conditions described below. Subsequently, the amount of developed toner (g/$m^2$) determined by a developed image on an electrophotographic photoreceptor 10, a transfer efficiency (%) determined by a transferred toner image transported from the electrophotographic photoreceptor 10 to an intermediate transfer belt 52, and a silica coating ratio of the surface of the electrophotographic photoreceptor 10 after cleaning are measured.

The silica coating ratio is calculated as follows. After the images each having an area coverage of 5% are successively output on 1,000 sheets, a photograph of a region of the image portion of the surface of the electrophotographic photoreceptor 10, the region extending from a cleaning portion to a charging device 20, is taken with a laser microscope (VK9500 manufactured by Keyence Corporation). A portion to which silica adheres is black. Thus, binarization is performed by image analysis to calculate a coating ratio of the external additive. More specifically, an image (magnification: ×3000) captured by the laser microscope is binarized with a white/black super search mode using image processing software "Image J" to calculate the area ratio of the portion to which silica adheres. Thus, the silica coating ratio is determined.

(Development Conditions)

Center of facing distance between developing roller and electrophotographic photoreceptor (drum to roll space (DRS)): 300 μm (factor comparison standard: 250 to 300 μm)

Center of amount of developer on developing roller (mass on sleeve (MOS)): 300 g/$m^2$ (factor comparison standard: 250 to 420 g/$m^2$)

Rotation speed of electrophotographic photoreceptor: 300 mm/sec

Rotation speed of developing roller (process speed): 360 to 700 mm/sec

Rotation direction of developing roller (MRS):

The same direction as the moving direction of electrophotographic photoreceptor ("identical" direction) at a peripheral velocity ratio of 1.7 to 2.3

Direction opposite to the moving direction of electrophotographic photoreceptor ("reverse" direction) at a peripheral velocity ratio of 1.2

Surface shape and roughness of developing roller: Groove sleeve with a 0.8 mm pitch Diameter of developing roller: ϕ 18 mm Magnetic force of developing pole on developing roller: 125 mT Magnet set angle (MSA) of developing roller: upstream side 3 degrees DC component voltage of voltage applied to developing roller: 550 V Difference between DC component voltage of voltage applied to developing roller and photoreceptor surface potential corresponding to background of image (Vcln): 125 V AC component voltage (developing AC bias) waveform superimposed on DC component voltage (DC) applied to developing roller: sine wave (rectangular wave)

Amplitude of developing AC bias (Vp-p: peak to peak voltage): 1.75 kV

Proportion of AC component voltage in applied voltage (developing AC bias duty): 50%

Frequency of developing AC bias: 10 kHz (Evaluation Criteria)

[Developability]

A: The amount of developed toner is 4.0 (g/$m^2$) or more.

B: The amount of developed toner is 3.5 (g/$m^2$) or more and less than 4.0 (g/$m^2$).

C: The amount of developed toner is less than 3.5 (g/$m^2$).

[Transferability]

A: The transfer efficiency exceeds 95%.

B: The transfer efficiency is 90% or more and 95% or less.

C: The transfer efficiency is less than 90%.

[Contamination of Photoreceptor]

A: The silica coating ratio is less than 10%.

B: The silica coating ratio is 10% or more and 20% or less.

C: The silica coating ratio is more than 20%.

[Comprehensive Evaluation Result]

A: No problem

B: Acceptable

C: Unacceptable

FIG. 3 is a table showing the conditions of Examples and Comparative Examples, and FIG. 4 is a table showing the results of Examples and Comparative Examples.

Example 2

The evaluation is performed as in Example 1 except that the value of MOS of the developing device 40 in Example 1 is changed to 250 ($g/m^2$) to set the value of MOS/DRS to 0.83. According to the results, as shown in FIGS. 3 and 4, the developability is 3.8 ($g/m^2$), which is lower than that of Example 1, and the contamination of the photoreceptor tends to increase to 17%. The comprehensive evaluation result is "acceptable".

Example 3

The evaluation is performed as in Example 1 except that the value of MOS of the developing device 40 in Example 1 is changed to 350 ($g/m^2$) to set the value of MOS/DRS to 1.17. The developability is 4.3 ($g/m^2$), which is higher than that of Example 1, and the contamination of the photoreceptor tends to be suppressed to 7%, though the degree of improvement is very small.

Example 4

The evaluation is performed as in Example 1 except that the value of MOS of the developing device 40 in Example 1 is changed to 420 ($g/m^2$) to set the value of MOS/DRS to a high value of 1.67. The developability is 4.6 ($g/m^2$), which is higher than that of Example 1, and the contamination of the photoreceptor tends to be suppressed to 6%. However, since the value of MOS of the developing device 40 in Example 4 is large, namely, 420 ($g/m^2$), an increase in a driving torque for driving the developing roller is observed.

Example 5

The evaluation is performed as in Example 1 except that the peripheral velocity ratio of the peripheral velocity of the developing roller 42 of the developing device 40 to the peripheral velocity of the electrophotographic photoreceptor 10 in Example 1 is changed to 2.3. The developability is 4.5 ($g/m^2$), which is higher than that of Example 1, and the contamination of the photoreceptor tends to be suppressed to 5%. The reason for this is believed to be as follows. By setting the peripheral velocity ratio of the peripheral velocity of the developing roller 42 of the developing device 40 to the peripheral velocity of the electrophotographic photoreceptor 10 to a large value, namely, 2.3, frictional electrification of the external additive adhering to the surface of the electrophotographic photoreceptor 10 is promoted. Thus, the contamination of the photoreceptor is suppressed.

Example 6

The evaluation is performed as in Example 1 except that, in Example 1, the developing roller 42 of the developing device 40 is rotated in the same direction as the electrophotographic photoreceptor 10 so that the moving direction of the developing roller 42 and the moving direction of the electrophotographic photoreceptor 10 are opposite to each other in the facing portion, and the peripheral velocity ratio is changed to 1.2. The developability is 4.2 ($g/m^2$), which is slightly higher than that of Example 1, and the contamination of the photoreceptor tends to be suppressed to 5%.

Example 7

The evaluation is performed as in Example 1 except that an external additive having a particle size of 86 nm and an average circularity of 0.75 is used as the external additive of the developer in Example 1. The developability is 4.0 ($g/m^2$), which is lower than that of Example 1 though the degree of decrease is very small, and the transferability also tends to decrease to 92%. However, the contamination of the photoreceptor tends to be suppressed to 6%. The reason for this is believed that since the external additive having a relatively small particle size of 86 nm is used, the transferability decreases.

Example 8

The evaluation is performed as in Example 1 except that an external additive having a particle size of 122 nm and an average circularity of 0.83 is used as the external additive of the developer in Example 1. The developability is 4.0 ($g/m^2$), which is lower than that of Example 1 though the degree of decrease is very small. However, the transferability improves to 98%, which is higher than that of Example 1. The reason for this is believed that since the external additive having a relatively large particle size of 122 nm is used, the transferability improves. However, the contamination of the photoreceptor tends to increase to 16%.

Comparative Example 1

In Comparative Example 1, the evaluation is performed as in. Example 1 except that an electrophotographic photoreceptor having a top surface layer that contains no fluorocarbon resin particles is used as the electrophotographic photoreceptor 10. The developability is 4.1 ($g/m^2$), which is the same as that of Example 1. However, the transferability decreases to 92% and the contamination of the photoreceptor increases to 32%. The comprehensive evaluation result is "unacceptable".

The reason for this is believed to be as follows. Since an electrophotographic photoreceptor having a top surface layer that contains no fluorocarbon resin particles is used as the electrophotographic photoreceptor 10, the external additive adhering to the surface of the electrophotographic photoreceptor 10 cannot be removed and the contamination of the photoreceptor increases.

Comparative Example 2

In Comparative Example 2, an external additive produced as described below is used.

[Granulation Step]

Alkali catalyst solution preparation step (Preparation of alkali catalyst solution (4))

In a 3-L glass reaction container equipped with a metal stirring rod, a dropping nozzle (microtube pump composed of Teflon (registered trademark)), and a thermometer, 300 parts by mass of methanol and 47.4 parts by mass of a 10% aqueous ammonia are put, and mixed while stirring to prepare an alkali catalyst solution (4).

Particle generation step (Preparation of silica particle suspension)

Next, the temperature of the alkali catalyst solution (4) is adjusted to 25° C., and the alkali catalyst solution (4) is purged with nitrogen. Subsequently, 450 parts by mass of tetramethoxysilane (TMOS) and 270 parts by mass of aqueous ammonia having a catalyst ($NH_3$) concentration of 4.44% are added dropwise to the alkali catalyst solution (4) at the same time at the rates described below while stirring the alkali catalyst solution (4). Thus, a suspension of silica particles (silica particle suspension (4)) is prepared.

In this step, the tetramethoxysilane is supplied at a rate of 7.08 parts by mass/min, and the 4.44% aqueous ammonia is supplied at a rate of 4.25 parts by mass/min.

The volume-average particle size ($D50_v$) of the particles in the silica particle suspension (4) is measured with the particle size analyzer described above. The volume-average particle size ($D50_v$) is 58 nm.

[Drying Step]

Next, the prepared suspension of hydrophilic silica particles (hydrophilic silica particle dispersion liquid) is spray-dried to remove the solvent. Thus, a powder of hydrophilic silica particles (4) is prepared.

[Hydrophobizing Treatment Step]

Next, 100 parts by mass of the powder of the hydrophilic silica particles (4) is put in a mixer, and stirred at 200 rpm while being heated at 200° C. in a nitrogen atmosphere. Furthermore, 30 parts by mass of hexamethyldisilazane (HMDS) is added dropwise to the powder of the hydrophilic silica particles and allowed to react for two hours. The powder is then cooled to prepare a powder of hydrophobic silica particles that has been subjected to a hydrophobizing treatment.

The prepared hydrophobic silica particles (4) are added to toner particles, and SEM photographs of 100 primary particles of the hydrophobic silica particles are taken. Next, image analysis of the SEM photographs is conducted. According to the results, the primary particles of the hydrophobic silica particles have an average circularity of 0.75.

In Comparative Example 2, the evaluation is performed as in Example 1 except that the external additive having a particle size of 58 nm is used. According to the results, charging becomes somewhat high, the developability is 3.9 ($g/m^2$), and the transferability decreases to 83%. According to the results of the analysis of the toner after the development, it is found that a large proportion of the external additive is embedded in the toner particles.

Comparative Example 3

In Comparative Example 3, an external additive produced as described below is used.

[Granulation Step]

Alkali catalyst solution preparation step (Preparation of alkali catalyst solution (5))

In a 3-L glass reaction container equipped with a metal stirring rod, a dropping nozzle (microtube pump composed of Teflon (registered trademark)), and a thermometer, 300 parts by mass of methanol and 48.9 parts by mass of a 10% aqueous ammonia are put, and mixed while stirring to prepare an alkali catalyst solution (5).

Particle generation step (Preparation of silica particle suspension)

Next, the temperature of the alkali catalyst solution (5) is adjusted to 25° C., and the alkali catalyst solution (5) is purged with nitrogen. Subsequently, 450 parts by mass of tetramethoxysilane (TMOS) and 270 parts by mass of aqueous ammonia having a catalyst ($NH_3$) concentration of 4.44% are added dropwise to the alkali catalyst solution (5) at the same time at the rates described below while stirring the alkali catalyst solution (5). Thus, a suspension of silica particles (silica particle suspension (5)) is prepared.

In this step, the tetramethoxysilane is supplied at a rate of 2.12 parts by mass/min, and the 4.44% aqueous ammonia is supplied at a rate of 1.27 parts by mass/min.

The volume-average particle size ($D50_v$) of the particles in the silica particle suspension (5) is measured with the particle size analyzer described above. The volume-average particle size ($D50_v$) is 120 nm.

[Drying Step]

Next, the prepared suspension of hydrophilic silica particles (hydrophilic silica particle dispersion liquid) is spray-dried to remove the solvent. Thus, a powder of hydrophilic silica particles (5) is prepared.

[Hydrophobizing Treatment Step]

Next, 100 parts by mass of the powder of the hydrophilic silica particles (5) is put in a mixer, and stirred at 200 rpm while being heated at 200° C. in a nitrogen atmosphere. Furthermore, 30 parts by mass of hexamethyldisilazane (HMDS) is added dropwise to the powder of the hydrophilic silica particles and allowed to react for two hours. The powder is then cooled to prepare a powder of hydrophobic silica particles that has been subjected to a hydrophobizing treatment.

The prepared hydrophobic silica particles (5) are added to toner particles, and SEM photographs of 100 primary particles of the hydrophobic silica particles are taken. Next, image analysis of the SEM photographs is conducted. According to the results, the primary particles of the hydrophobic silica particles have an average circularity of 0.96.

In Comparative Example 3, the evaluation is performed as in Example 1 except that the external additive having an average circularity of 0.96 is used. There are no problems in terms of developability and transferability. However, the coating ratio of the external additive on the photoreceptor is high, namely, 28%, and image defects are generated.

As shown in FIGS. 3 and 4, when fluorocarbon resin particles are dispersed in the top surface layer of the electrophotographic photoreceptor 10, the value of MOS/DRS in the developing device 40 satisfies a particular range, and the volume-average particle size and the average circularity of an external additive of a toner satisfy particular ranges, the transferability of the toner is improved and it is possible to suppress the adhesion of an external additive of the toner to the surface of the electrophotographic photoreceptor 10 even in the case where the developability of the developing device 40 is improved.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic image developer comprising:

a toner that contains an external additive having a volume-average particle size of about 80 nm or more and about 400 nm or less and an average circularity of about 0.7 or more and about 0.85 or less, wherein the electrostatic image developer is used in an image forming apparatus including an image-carrying member that has a top surface layer containing fluorocarbon resin particles dispersed therein and that carries an electrostatic latent image, and a developer-carrying member that is arranged so as to face the image-carrying member and that carries an electrostatic image developer, in which a value obtained by dividing the amount of developer per unit area carried on the developer-carrying member [g/m$^2$] by a shortest distance between the image-carrying member and the developer-carrying member [μm] is about 0.8 or more and about 1.8 or less, and a peripheral velocity ratio of a peripheral velocity of the developer-carrying member to a peripheral velocity of the image-carrying member is about 1.5 or more and about 5.0 or less or the developer-carrying member moves in a direction opposite to a moving direction of the image-carrying member in a portion where the developer-carrying member and the image-carrying member face each other.

2. The electrostatic image developer according to claim 1, wherein the fluorocarbon resin particles have an average primary particle size of about 0.05 μm or more and about 1 μm or less.

3. The electrostatic image developer according to claim 1, wherein the content of the fluorocarbon resin particles is about 1% by mass or more and about 30% by mass or less.

4. The electrostatic image developer according to claim 1, wherein the amount of the external additive relative to the toner is about 1% by mass or more.

5. An image forming apparatus comprising:

an image-carrying member that carries an electrostatic latent image and has a top surface layer containing fluorocarbon resin particles dispersed therein; and a developer-carrying member that is arranged so as to face the image-carrying member and that carries an electrostatic image developer, in which a value obtained by dividing the amount of developer per unit area carried on the developer-carrying member [g/m$^2$] by a shortest distance between the image-carrying member and the developer-carrying member [μm] is about 0.8 or more and about 1.8 or less; and a peripheral velocity ratio of a peripheral velocity of the developer-carrying member to a peripheral velocity of the image-carrying member is about 1.5 or more and about 5.0 or less or the developer-carrying member rotates in a same direction, wherein the electrostatic image developer contains a toner including an external additive having a volume-average particle size of about 80 nm or more and about 400 nm or less and an average circularity of about 0.7 or more and about 0.85 or less.

6. The image forming apparatus according to claim 5, wherein the developer-carrying member includes a first developer-carrying member that rotates in a same direction as the image-carrying member, and a second developer-carrying member that is arranged on the downstream side of the first developer-carrying member in the rotating direction of the image-carrying member and that rotates in an opposite direction to the image-carrying member.

* * * * *